US008852836B2

(12) United States Patent
Seki et al.

(10) Patent No.: US 8,852,836 B2
(45) Date of Patent: Oct. 7, 2014

(54) TONER, METHOD FOR PRODUCING THE SAME, AND IMAGE FORMING APPARATUS

(75) Inventors: Masahiro Seki, Nara (JP); Yoshitaka Sekiguchi, Hyogo (JP); Ryota Inoue, Osaka (JP); Kazuoki Fuwa, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 61 days.

(21) Appl. No.: 13/525,685

(22) Filed: Jun. 18, 2012

(65) Prior Publication Data

US 2012/0328976 A1 Dec. 27, 2012

(30) Foreign Application Priority Data

Jun. 21, 2011 (JP) ..... 2011-137493

(51) Int. Cl.

| | |
|---|---|
| ***G03G 9/08*** | (2006.01) |
| ***G03G 9/087*** | (2006.01) |
| ***G03G 9/097*** | (2006.01) |
| ***G03G 5/147*** | (2006.01) |

(52) U.S. Cl.

CPC ..... *G03G 5/14795* (2013.01); *G03G 9/08797* (2013.01); *G03G 9/09783* (2013.01); *G03G 9/09733* (2013.01); *G03G 5/14786* (2013.01); *G03G 9/09791* (2013.01); *G03G 9/097* (2013.01); *G03G 9/08795* (2013.01)

USPC ..... 430/108.3; 430/110.3; 430/111.41; 430/108.4; 430/110.1

(58) Field of Classification Search

CPC ..... G03G 9/09783

USPC ..... 430/110.3, 111.41, 108.4, 108.3

See application file for complete search history.

(56) References Cited

U.S. PATENT DOCUMENTS

| | | | | |
|---|---|---|---|---|
| 5,219,694 | A * | 6/1993 | Anno et al. | 430/108.1 |
| 5,683,845 | A * | 11/1997 | Sata et al. | 430/108.11 |
| 6,566,025 | B1 * | 5/2003 | McStravick et al. | 430/108.11 |
| 2009/0246669 | A1 * | 10/2009 | Uno | 430/108.2 |
| 2013/0236825 | A1 * | 9/2013 | Sweeney et al. | 430/108.11 |

FOREIGN PATENT DOCUMENTS

| | | |
|---|---|---|
| JP | 10-142840 | 5/1998 |
| JP | 11-174738 | 7/1999 |
| JP | 2007-25655 | 2/2007 |
| JP | 2008-89918 | 4/2008 |

* cited by examiner

*Primary Examiner* — Christopher Rodee

(74) *Attorney, Agent, or Firm* — Oblon, Spivak, McClelland, Maier & Neustadt, L.L.P.

(57) ABSTRACT

A toner including: a base resin; and charge-controlling resin particles contained in the base resin, wherein the toner is in shape of particles, and the charge-controlling resin particles are present in a region of each toner particle which is 500 nm in depth from a surface of the toner particle and an average of amounts of the charge-controlling resin particles present in the regions of the toner particles is 20% by volume to 70% by volume, wherein an average of embedment rates of the charge-controlling resin particles in the toner particles is 90% or higher, where each embedment rate is an average of embedment rates of the charge-controlling resin particles in each toner particle, and wherein the charge-controlling resin particles have a charge amount of 60 $\mu C/m^2$ or more as measured by a blow-off method.

6 Claims, 6 Drawing Sheets

TONER, METHOD FOR PRODUCING THE SAME, AND IMAGE FORMING APPARATUS

BACKGROUND OF THE INVENTION

1. Field of the Invention

The present invention relates to a toner, a method for producing the toner, and an image forming apparatus.

2. Description of the Related Art

In recent years, low-end laser beam printers have increasingly been reduced in cost, downsized and elevated in response speed, with targeting end users. For such downsizing and cost reduction, downsizing each part and simplifying apparatuses have been required.

For example, in a developing device mounted to an image forming apparatus, a one-component developing process without using a carrier can make the developing device smaller than a two-component developing process using a carrier as a developer component. This is because the developing device employing the one-component developing process requires a smaller number of parts.

The one-component developing process is a process including: frictionally charging toner particles by a toner-regulating member; and forming a toner image on a toner bearing member using the charged toner particles. Although the one-component developing process requires a simpler structure than the two-component developing process, the toner itself is required to have various functions.

In particular, it is important for the toner to have high mechanical strength and high charging performance. In addition, the toner has to be resistant to external stimuli.

Employable methods for producing the electrophotographic toner having high charging performance include: (1) a method in which a charge-controlling agent is attached uniformly to the surface of each of the granulated toner particles; and (2) a method in which a charge-controlling agent is used in addition to toner materials such as a resin and a colorant in the production step of toner base particles.

The above method (1) is, for example, a method in which external additives such as silica, alumina and titania are externally attached to toner base particles (e.g., a method in which toner base particles and external additives are mixed with a mixer such as HENSCHEL MIXER). The externally-added charge-controlling agent, however, tends to be exfoliated from the resultant toner base particles. As a result, it is impossible to keep the charge amount of the toner for a long time, which is one existing problem.

The above method (2) is, for example, the chemical toner method or the knead-milling method using a charge-controlling agent and/or a resin having charge-controlling effects.

For example, Japanese Patent Application Laid-Open (JP-A) No. 11-174738 proposes a toner including: a binder resin; a charge-controlling resin having an ionic functional group; and a releasing agent having an ionic functional group with the opposite polarity to that of the charge-controlling resin, wherein the binder resin and the charge-controlling resin each formed of molecular chains with which the binder resin and the charge-controlling resin have affinity with each other.

However, since this proposed toner is produced by the knead-milling method, the charge-controlling agent is dispersed entirely in each toner particle. As a result, the amount of the charge-controlling agent is small in the vicinity of the surface of the toner particle, and the charge amount of the toner is not satisfactory.

When the amount of the charge-controlling resin or the charge-controlling agent used is increased to increase the amount thereof in the vicinity of the surface of the toner particle, the formed toner particles become hard to be degraded in fixability on recording media.

In the solution suspension method belonging to the chemical toner method, incorporation of the charge-controlling agent would make it difficult to form toner particles. Even if incorporated, the charge-controlling agent is incorporated closer to the center of each toner particle, so that it cannot exert its effect satisfactorily.

As has already been known, the aggregation method belonging to the chemical toner method produces a core/shell toner having a core made of resin superior in thermal fixation and a shell of resin superior in charging performance.

For example, JP-A No. 2008-089918 proposes improving charging performance of the surface of a toner by uniformly dispersing the charge-controlling agent in the shell layer of the toner, in order for the charge-controlling agent to exert its functions satisfactorily.

In this proposal, however, since the surface layer of the toner is entirely covered with the shell layer containing the charge-controlling agent, the thermal properties of the toner as a whole are changed, and the functions of the ingredients contained in the core are prevented. For example, during fixing, the releasing agent (wax) is prevented from bleeding towards the toner surface, degrading fixing performance of the toner. Also, when the core/shell toner is used as a one-component developer, the shell may be removed due to rubbing between toner particles and/or stress applied at a part for regulating the amount of the toner. As a result, there are problems such as degradation of the charging performance of the toner, fusion of the toner to a regulating blade, and filming on a developing roller.

SUMMARY OF THE INVENTION

The present invention aims to solve the above existing problems and achieve the following object. Specifically, an object of the present invention is to provide a toner which is excellent charging performance and in mechanical strength required especially when used as a one-component developer, without degradation in other properties such as thermal property, background smear-preventive property, low-temperature fixing property and releasing property.

Means for solving the above problems are as follows. Specifically, a toner of the present invention includes: a base resin; and charge-controlling resin particles contained in the base resin, wherein the toner is in shape of particles, and the charge-controlling resin particles are present in a region of each toner particle which is 500 nm in depth from a surface of the toner particle and an average of amounts of the charge-controlling resin particles present in the regions of the toner particles is 20% by volume to 70% by volume, wherein an average of embedment rates of the charge-controlling resin particles in the toner particles is 90% or higher, where each embedment rate is an average of embedment rates of the charge-controlling resin particles in each toner particle, and wherein the charge-controlling resin particles have a charge amount of 60 $\mu C/m^2$ or more as measured by a blow-off method.

The present invention can provide a toner which is excellent in charging performance and in mechanical strength required especially when used as a one-component developer, without degradation in other properties such as thermal property, background smear-preventive property, low-temperature fixing property and releasing property. This toner can solve the above existing problems and achieve the above object.

DETAILED DESCRIPTION OF THE INVENTION (Toner)

Figure 1:
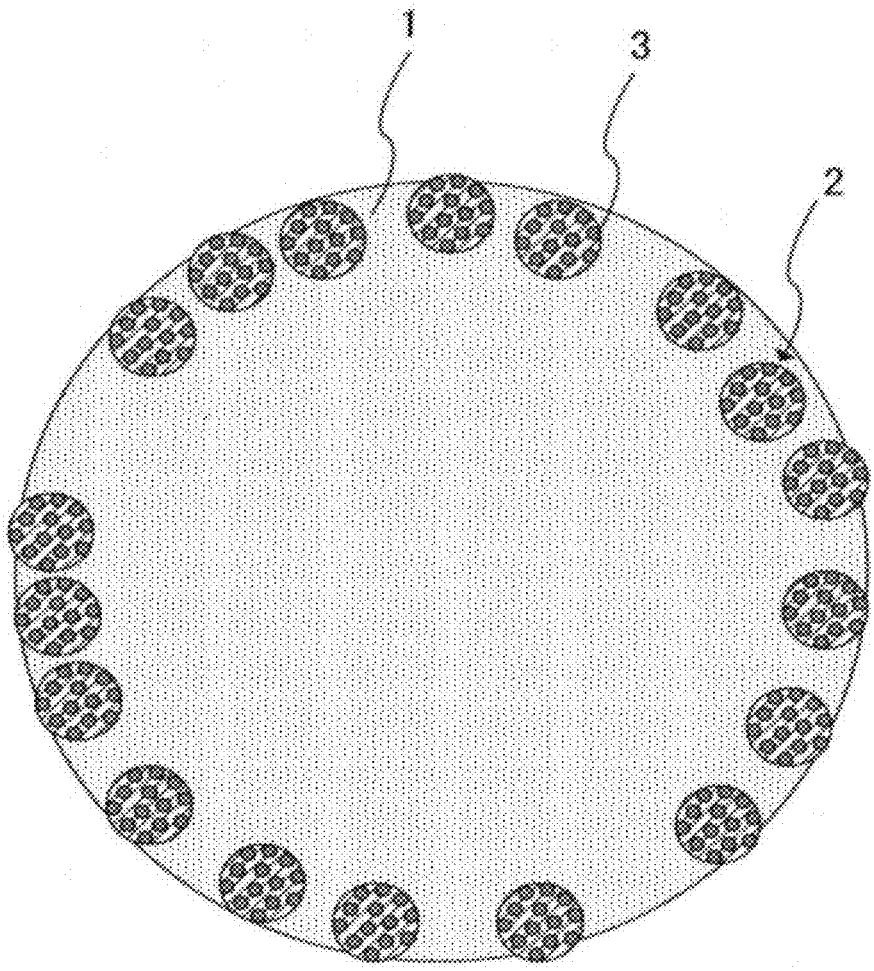
FIG. 1 is a schematic, cross-sectional view of a toner of the present invention.

A toner of the present invention includes a base resin and charge-controlling resin particles; and, if necessary, further includes other ingredients such as an inorganic dispersing agent, a releasing agent, a wax-dispersing agent and a colorant. A feature of the toner (toner particles) of the present invention is that the charge-controlling resin particles are present in a region of each toner particle which is 500 nm in depth from a surface of the toner particle and an average of amounts of the charge-controlling resin particles present in the regions of the toner particles is 20% by volume to 70% by volume, wherein an average of embedment rates of the charge-controlling resin particles in the toner particles is 90% or higher, where each embedment rate is an average of embedment rates of the charge-controlling resin particles in each toner particle, and wherein the charge-controlling resin particles have a charge amount of 60 $\mu C/m^2$ or more as measured by a blow-off method.

<Resin>

The resins used for the toner of the present invention (i.e., the base resin and the resin of the charge-controlling resin particles) are not particularly limited and may be those conventionally used for toner. Examples thereof include polyester resins, styrene-acryl resins, polyol resins, vinyl resins, polyurethane resins, epoxy resins, polyamide resins, polyimide resins, silicone resins, phenol resins, melamine resins, urea resins, aniline resins, ionomer resins and polycarbonate resins. Among them, the base resin used in the present invention is preferably polyester resins from the viewpoint of obtaining good fixability.

The resin of the charge-controlling resin particles in the present invention may be any of the above-listed resins. However, the charge-controlling resin particles have to be independently located as domains in the base resin; i.e., it is necessary for the base resin not to be in compatible state to the resin of the charge-controlling resin particles. Also, the charge-controlling resin particles have to be disposed only near the toner surface relating to the charging performance of the toner. For the above reasons, more preferred are vinyl resins which have high charging performance.

For example, when the dissolution suspension method is used to produce the toner of the present invention, the locations of the charge-controlling resin particles in the toner greatly depend on the combination of the base resin and the resin of the charge-controlling resin particles.

For example, when the base resin and the resin of the charge-controlling resin particles are both polyester resins, the charge-controlling resin particles are highly likely to exist closer to the center of each toner particle regardless of whether these polyester resins are compatible to each other. In contrast, when the combination of the base resin and the resin of the charge-controlling resin particles is a combination of resins having different structures such as a combination of a polyester resin and a vinyl resin, the charge-controlling resin particles tend to be located near the toner surface, so that the charge-controlling resin particles exist in the toner surface layer.

Figure 2:
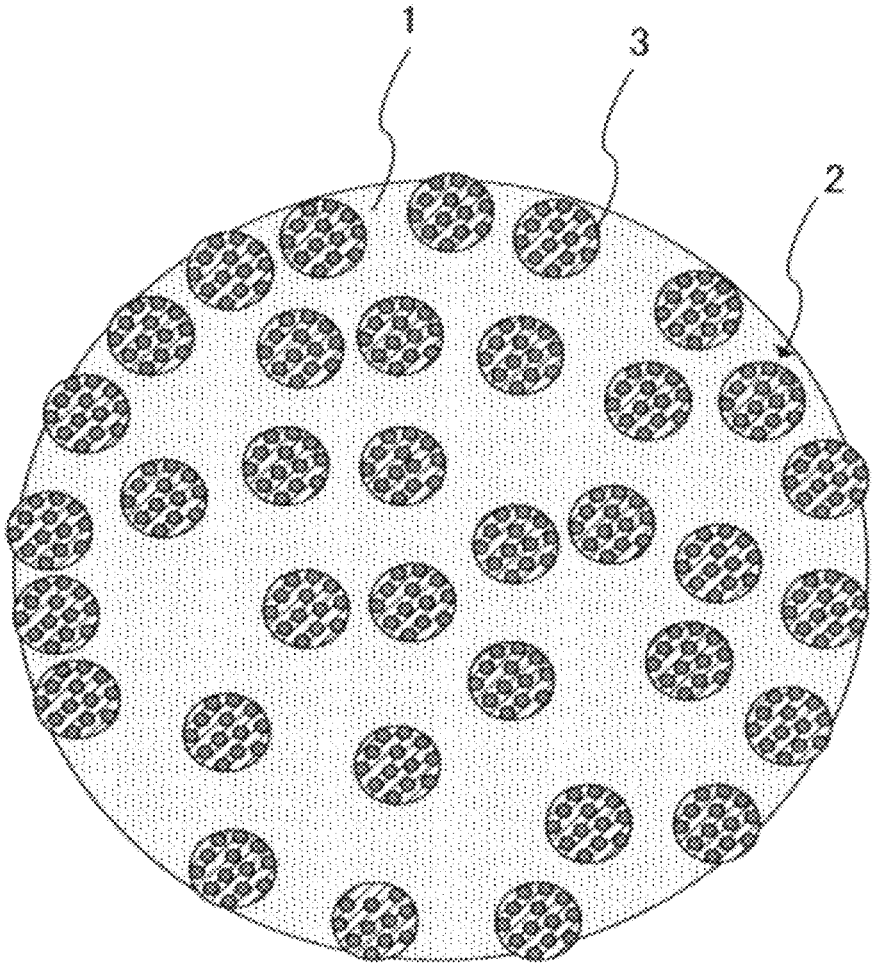
FIG. 2 is a schematic, elevational view of the arrangement of charge-controlling resin particles in the surface of a toner of the present invention.

Referring now to FIGS. 1 and 2, the structure of the toner of the present invention will be described.

FIG. 1 is a schematic, cross-sectional view of the toner of the present invention, and FIG. 2 is a schematic, elevational view of the arrangement of the charge-controlling resin particles in the surface of the toner of the present invention. In the toner illustrated in FIG. 1 or 2, the charge-controlling resin particles each contain a charge-controlling agent. The toner of the present invention contains a base resin 1 (core) and charge-controlling resin particles 2 present on the surface layer thereof, where the charge-controlling resin particles 2 are embedded in the base resin 1 (here, FIG. 2 illustrates only the arrangement of the charge-controlling resin particles without considering their embedment rate). The charge-controlling resin particles 2 may contain a charge-controlling agent 3. The charge-controlling agent 3 located in the surface layer of the toner provides high charging performance. The charge-controlling resin particles 2 each containing the charge-controlling agent 3 do not entirely cover the surface of the base resin 1 but are independently located as domains in the toner surface layer. Thus, the charge-controlling resin particles 2 do not adversely affect the properties of the core; for example, they do not prevent the releasing agent from exuding during fixation. Also in the toner of the present invention, the charge-controlling resin particles 2 are embedded in the base resin 1 (core), thereby providing the toner with durability (mechanical strength).

Figure 3:
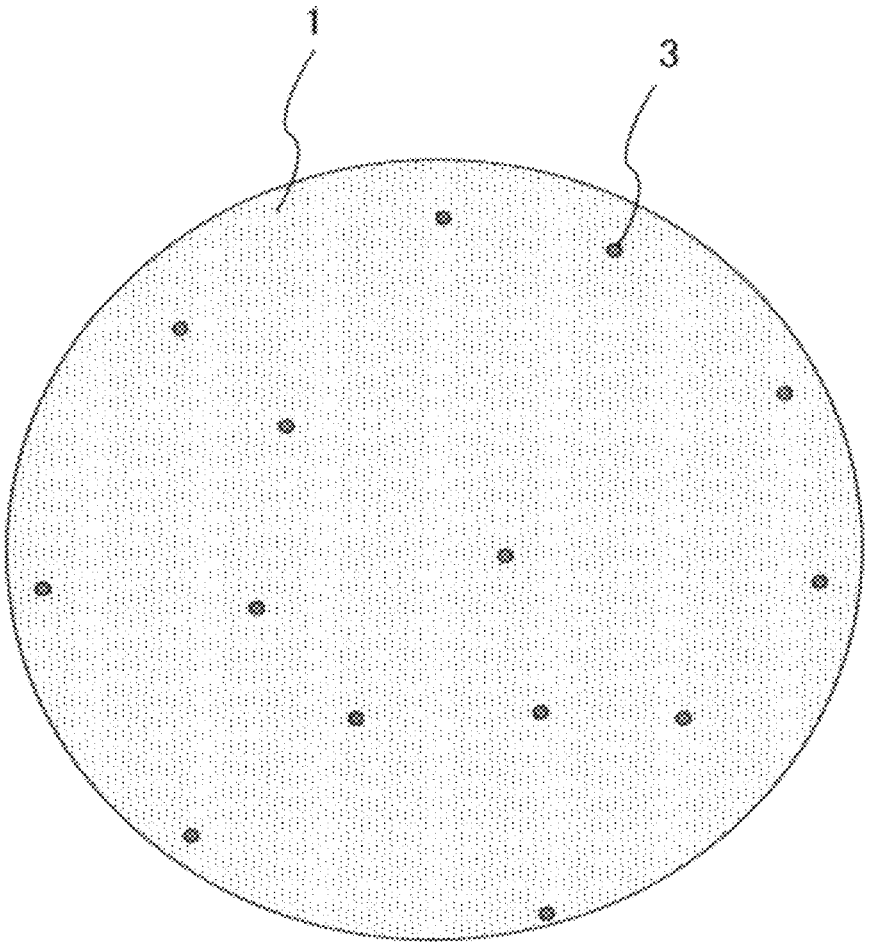
FIG. 3 is a schematic, elevational view of a conventional toner.

When the charge-controlling agent 3 is incorporated into the toner by, for example, the conventional pulverization method or dissolution suspension method, not much of the charge-controlling agent exists in the toner surface layer as illustrated in FIG. 3, so that it cannot exert satisfactory charging performance.

<<Base Resin>>

As described above, the base resin usable may be any of the above-listed resins among which a polyester resin is preferred. Alternatively, the base resin may be a resin obtained by allowing a modified resin with a terminal isocyanate group (isocyanate-modified resin) to undergo elongation or crosslinking reaction of the isocyanate in the below-described aging step.

The isocyanate-modified resin is not particularly limited and may be appropriately selected depending on the intended purpose. It is preferably an isocyanate-modified polyester resin from the viewpoint of obtaining good fixability.

The isocyanate-modified polyester resin is, for example, a reaction product obtained through reaction between polyisocyanate (3) and an active hydrogen group-containing polyester resin, which is a polycondensate formed between polyol (1) and polycarboxylic acid (2). Examples of the active hydrogen group the polyester resin has include a hydroxyl group (an alcoholic or phenolic hydroxyl group), an amino group, a carboxyl group and a mercapto group, with an alcoholic hydroxyl group being preferred.

—Polyol—

Examples of the polyols (1) include diols (1-1) and trihydric or higher polyols (1-2), with (1-1) alone or a mixture containing (1-1) and a small amount of (1-2) being preferred.

Examples of the diols (1-1) include alkylene glycols (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexanedimethanol and hydrogenated bisphenol A); bisphenols (e.g., bisphenol A, bisphenol F and bisphenol S); and adducts of the above-listed alicyclic diols with alkylene oxides (e.g., ethylene oxide, propylene oxide and butylene oxide).

Among them, preferred are C2 to C12 alkylene glycols and alkylene oxide adducts of bisphenols. Particularly preferred are combinations of alkylene oxide adducts of bisphenols and C2 to C12 alkylene glycols.

Examples of the trihydric or higher polyols (1-2) include trihydric or higher aliphatic polyalcohols (e.g., glycerin, trimethylolethane, trimethylolpropane, pentaerythritol and sorbitol); trihydric or higher phenols (e.g., trisphenol PA, phenol novolac and cresol novolac); and alkylene oxide adducts of the above trihydric or higher polyp henols.

—Polycarboxylic Acid—

Examples of the polycarboxylic acids (2) include dicarboxylic acids (2-1) and trivalent or higher polycarboxylic acids (2-2), with (2-1) alone or a mixture containing (2-1) and a small amount of (2-2) being preferred.

Examples of the dicarboxylic acids (2-1) include alkylene dicarboxylic acids (e.g., succinic acid, adipic acid and sebacic acid); alkenylene dicarboxylic acids (e.g., maleic acid and fumaric acid); and aromatic dicarboxylic acids (e.g., phthalic acid, isophthalic acid, terephthalic acid and naphthalene dicarboxylic acid). Among them, preferred are C4 to C20 alkenylenedicarboxylic acids and C8 to C20 aromatic dicarboxylic acids.

Examples of the trivalent or higher polycarboxylic acids (2-2) include C9 to C20 aromatic polycarboxylic acids (e.g., trimellitic acid and pyromellitic acid).

Notably, the polycarboxylic acids (2) to be reacted with the polyols (1) may be anhydrides or lower alkyl esters (e.g., methyl ester, ethyl ester and isopropyl ester) of the above carboxylic acids.

The ratio between the polyol (1) and the polycarboxylic acid (2) is generally 1/1 to 2/1, preferably 1/1 to 1.5/1, more preferably 1.02/1 to 1.3/1, in terms of the equivalent ratio [OH]/[COOH] of the hydroxyl group [OH] to the carboxyl group [COOH].

—Polyisocyanate—

The polyisocyanate (3) is not particularly limited and may be appropriately selected depending on the intended purpose. Examples thereof include: aliphatic polyisocyanates (e.g., tetramethylene diisocyanate, hexamethylene diisocyanate and 2,6-diisocyanatomethylcaproate); alicyclic polyisocyanates (e.g., isophoron diisocyanate and cyclohexylmethane diisocyanate); aromatic diisocyanates (e.g., tolylene diisocyanate and diphenylmethane diisocyanate); aromatic aliphatic diisocyanates (e.g., α,α,α',α'-tetramethylxylylene diisocyanate); isocyanurates; blocked products of the above polyisocyanates with, for example, a phenol derivative, oxime or caprolactam; and combinations thereof.

The ratio between the polyisocyanate (3) and the polyester resin is generally 1/1 to 5/1, preferably 1.2/1 to 4/1, more preferably 1.5/1 to 2.5/1, in terms of the equivalent ratio [NCO]/[OH] of the isocyanate group [NCO] to the hydroxyl group [OH]. When the ratio [NCO]/[OH] exceeds 5/1, the remaining polyisocyanate compound may adversely affect the chargeability of the formed toner.

—Elongating Agent—

An amine (B) may be used as an elongating agent for elongating the isocyanate-modified polyester resin.

The amine (B) is not particularly limited and may be appropriately selected depending on the intended purpose. Examples thereof include diamines (B1), trivalent or higher polyamines (B2), amino alcohols (B3), aminomercaptans (B4), amino acids (B5), and amino-blocked product (B6) of the amines (B1) to (B5).

Examples of the diamine (B1) include aromatic diamines (e.g., phenylene diamine, diethyltoluene diamine, 4,4'-diaminodiphenylmethane, tetrafluoro-p-xylylenediamine and tetrafluoro-p-phenylenediamine); alicyclic diamines (e.g., 4,4'-diamino-3,3'-dimethyldicyclohexylmethane, diaminecyclohexane and isophorondiamine); and aliphatic diamines (e.g., ethylenediamine, tetramethylenediamine, hexamethylenediamine, dodecafluorohexylenediamine and tetracosafluorododecylenediamine).

Examples of the trivalent or higher polyamine (B2) include diethylenetriamine and triethylenetetramine.

Examples of the aminoalcohol (B3) include ethanolamine and hydroxyethylaniline.

Examples of the aminomercaptan (B4) include aminoethylmercaptan and aminopropylmercaptan.

Examples of the amino acid (B5) include aminopropionic acid and aminocaproic acid.

Examples of the amino-blocked products (B6) obtained by blocking the amino group of B1 to B5 include oxazolidine compounds and ketimine compounds derived from the amines B1 to B5 and ketones (e.g., acetone, methyl ethyl ketone and methyl isobutyl ketone).

Among these amines (B), preferred are B1 and a mixture containing B1 and a small amount of B2.

The ratio between the amine (B) and the isocyanate-modified polyester resin is generally 1/2 to 2/1, preferably 1.5/1 to 1/1.5, more preferably 1.2/1 to 1/1.2, in terms of the equivalent ratio [NCO]/[$NH_X$] of the isocyanate group [NCO] to the amino group [$NH_X$]. When the ratio [NCO]/[$NH_X$] is less than ½ or more than 2/1, the elongation reaction of the isocyanate-modified polyester resin does not sufficiently proceed, resulting in that viscoelastic properties cannot be obtained in some cases.

The isocyanate-modified polyester resin may be used alone but, for example, when one or more types of linear isocyanate-modified polyester resins and one or more types of branched isocyanate-modified polyester resins are used in combination, the viscoelasticity of the obtained toner can be adjusted as desired. In particular, in order for the toner to uniformly contain crosslinked structures each having crosslinking points located at a large distance from each other, preferably, a branched isocyanate-modified polyester resin is designed so as to have a relatively low molecular weight and the branched isocyanate-modified polyester resin is used in combination with a linear isocyanate-modified polyester resin. Use of the isocyanate-modified polyester resin designed so as to have a long molecular chain may degrade thermal property of the formed toner. One possible reason for this is that the long molecular chain thereof is shrunk in the form of random coil in the oil phase during the toner production process, to thereby form crosslinked structures locally. Another possible reason is that the reaction of the isocyanate groups is completed in the molecule, so that crosslinked structures are not formed in the toner entirely.

Notably, in the present invention, the isocyanate-modified polyester resin may be used in combination with a polyester resin which is not modified with isocyanate (unmodified polyester resin). Use of the unmodified polyester resin makes it easier to design the viscoelasticity of the formed toner. Examples of the unmodified polyester resin include polycondensates formed between the above-listed polyols (1) and the above-listed polycarboxylic acids (2).

<<Charge-Controlling Resin Particles>>

In the present invention, the charge-controlling resin particles refer to resin particles having charge-controlling property. The resin particles may intrinsically have charge-controlling property, or the resin particles may contain a charge-controlling agent to have charge-controlling property.

Here, the resin particles having charge-controlling property refer to resin particles which have a sufficient charge amount after mixed and stirred with carrier particles. The charge amount of the charge-controlling resin particles as measured by a blow-off method is 60 $\mu C/m^2$ or more, preferably 100 $\mu C/m^2$ to 300 $\mu C/m^2$, still more preferably 120 $\mu C/m^2$ to 280 $\mu C/m^2$, further preferably 130 $\mu C/m^2$ to 250 $\mu C/m^2$. When the charge amount thereof is less than 60 $\mu C/m^2$, the charge-controlling resin particles cannot impart sufficient charging performance to the toner.

Here, the "charge amount as measured by a blow-off method" can be measured as follows. Specifically, a mixture containing charge-controlling resin particles and carrier particles in a ratio by mass of 5/95 (charge-controlling resin particles/carrier particles) is rotated at 200 rpm for 5 min. The thus-stirred charge-controlling resin particles are measured for charge amount per unit area (Q/S) which is the "charge amount as measured by a blow-off method." The charge amount per unit area (Q/S) can be measured with charge amount measuring device TB-200 (product of TOSHIBA CORPORATION).

Among the toner particles, the average amount of the charge-controlling resin particles present in a region of each toner particle which is 500 nm in depth from a surface of the toner particle is 20% by volume to 70% by volume, preferably 40% by volume to 60% by volume. When the average amount thereof is less than 20% by volume, the charge-imparting ability cannot be obtained satisfactorily. Whereas when it is more than 70% by volume, the charge-controlling resin particles form a resin layer on the toner surface, degrading the low-temperature fixing property of the toner. In the toner (toner particles) of the present invention where the average amount of the charge-controlling resin particles present in the above region falls within the above range, the charge-controlling resin particles do not assume a uniform coat film on the surface of the toner. Thus, the charge-controlling resin particles affect the low-temperature fixing property of the toner to a small extent. In addition, the charge-controlling resin particles exist near the toner surface and can impart charges thereto.

The charging performance of the toner depends on a product of the charging property of the charge-controlling resin particles, the amount of the charge-controlling resin particles contained in the base resin, and the average amount of the charge-controlling resin particles present in a region of each toner particle which is 500 nm in depth from a surface of the toner particle. In the toner of the present invention, the charging property and the average amount thereof preferably fall within the above corresponding numerical ranges.

Figure 5:
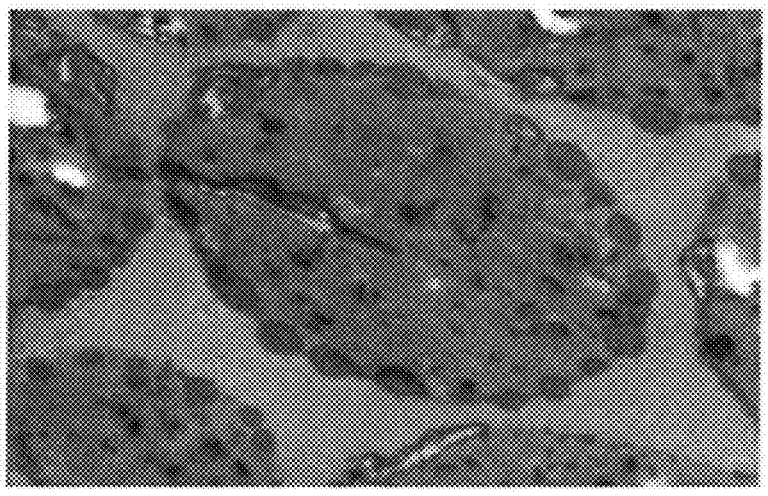
FIG. 5 is a scanning transmission electron microscope (STEM) image of the cross-section of a toner of the present invention.

The amount of the charge-controlling resin particles contained in the base resin and the amount of the charge-controlling resin particles present in a region of each toner particle which is 500 nm in depth from a surface of the toner particle can be calculated as follows, for example. Specifically, one toner particle is sliced with an ultramicrotome (product of Ultrasonic Co.) to prepare a thin section of the toner particle. Then, the thin section is observed under a scanning transmission electron microscope (STEM). The obtained cross-sectional image is used to calculate the amount of the charge-controlling resin particles as domains present in a region 500 nm in depth from the surface of the toner particle. The same procedure is performed on a plurality of toner particles, preferably 100 or more toner particles, to thereby calculate the amount of the charge-controlling resin particles contained in the base resin and the amount of the charge-controlling resin particles present in a region of each toner particle which is 500 nm in depth from a surface of the toner particle. The obtained amounts of the plurality of toner particles can be used to calculate the amount of the charge-controlling resin particles contained in the base resin and the average amount of the charge-controlling resin particles present in a region of each toner particle which is 500 nm in depth from a surface of the toner particle (see FIG. 5). The distance from the toner surface can be measured with, for example, the image analysis and particle size distribution measurement software MAC-VIEW (product of MOUNTECH Co., Ltd.). Notably, the amount of the charge-controlling resin particles present in a region 500 nm in depth from the surface of the toner particle is measured based on a ratio of the total area of the charge-controlling resin particles present in this region relative to the total area of all the charge-controlling resin particles. Thus, regarding the charge-controlling resin particles present on the boundary of this region, the partial areas within the region, divided by the boundary, are taken into consideration for evaluation.

The amount of the charge-controlling resin particles contained in the base resin is preferably 2 parts by mass to 14 parts by mass, more preferably 4 parts by mass to 9 parts by mass, per 100 parts by mass of the base resin. The average amount of the charge-controlling resin particles present in a region 500 nm in depth from the toner surface greatly depends on the amount of the charge-controlling resin particles relative to the base resin.

When the amount of the charge-controlling resin particles relative to the base resin is less than 2 parts by mass, there are formed toner particles where the average amount of the charge-controlling resin particles present in a region 500 nm in depth from the surface thereof is less than 20% by volume, so that the effects of the present invention cannot be obtained. When the amount of the charge-controlling resin particles relative to the base resin is more than 14 parts by mass, there are formed toner particles where the average amount of the charge-controlling resin particles present in a region 500 nm in depth from the surface thereof is more than 70% by volume. When it is more than 70% by volume, the intervals between the charge-controlling resin particles become small to cause the following failures; i.e., the charge-controlling resin particles prevent the functions of the ingredients contained in the core (for example, the charge-controlling resin particles prevent the releasing agent (wax) from bleeding towards the toner surface during fixation, degrading the fixing property of the toner); and the property of the charge-controlling resin particles becomes preferential, changing the thermal properties of the toner as a whole.

The average equivalent circle diameter of the charge-controlling resin particles is not particularly limited and may be appropriately selected depending on the intended purpose. It is preferably 90 nm to 400 nm, more preferably 100 nm to 350 nm. When the average equivalent circle diameter thereof is less than 90 nm, it may be difficult to incorporate a charge-controlling agent into the charge-controlling resin particles. Whereas when it is more than 400 nm, it may become difficult to incorporate the charge-controlling resin particles into the toner particle.

The average equivalent circle diameter of the charge-controlling resin particles can be measured as follows, for example. Specifically, a toner particle is sliced with an ultramicrotome (product of Ultrasonic Co.) to prepare a thin section of the toner particle. Then, the thin section is observed under a scanning transmission electron microscope (STEM). The obtained cross-sectional image is used to calculate the average equivalent circle diameter of the charge-controlling resin particles. The calculation of the average equivalent circle diameter thereof can be performed with, for example, the image analysis and particle size distribution measurement software MAC-VIEW (product of MOUNTECH Co., Ltd.).

The glass transition temperature of the charge-controlling resin particles is not particularly limited and may be appropriately selected depending on the intended purpose, but is preferably 65° C. or higher, more preferably 70° C. to 90° C. The glass transition temperature thereof can be measured with, for example, a differential scanning calorimeter (DSC-6220R, product of Seiko Instruments Inc.).

The following description will be given taking as an example a vinyl resin which is suitably used as the charge-controlling resin particles. When the vinyl resin does not contain a charge-controlling agent, preferably, the vinyl resin intrinsically has an easily chargeable structure. Thus, it is preferred to use a styrene monomer having an electron orbital where electrons stably exist as seen in an aromatic ring structure.

Here, the "styrene monomer" refers to an aromatic compound having a vinyl polymerizable functional group. Examples of the vinyl polymerizable functional group include vinyl, isopropenyl, allyl, acryloyl and methacryloyl.

Examples of the styrene monomer include styrene, α-methylstyrene, 4-methylstyrene, 4-ethylstyrene, 4-tert-butylstyrene, 4-methoxystyrene, 4-ethoxystyrene, 4-carboxystyrene or metal salts thereof, 4-styrenesulfonic acid or metal salts thereof, 1-vinylnaphthalene and 2-vinylnaphthalene.

Among them, it is preferred to mainly use styrene which is easily available, highly reactive and highly chargeable.

The amount of the styrene monomer forming the charge-controlling resin particles is preferably 20% by mass or more, more preferably 30% by mass to 50% by mass, in consideration of their charging property. When it is less than 20% by mass, satisfactory charging property cannot be obtained without addition of a charge-controlling agent.

As described above, when the resin used as the base resin has a different structure from that of the resin used as the charge-controlling resin particles; e.g., when a polyester resin is used as the base resin and a vinyl resin is used as the charge-controlling resin particles, the charge-controlling resin particles tend to exist near the toner surface. However, when only styrene with high hydrophobicity is used for forming the vinyl resin, the charge-controlling resin particles protrude from the toner surface since they have a totally different structure from that of the polyester resin. Therefore, it is preferred to add hydrophilic monomers. Examples of the hydrophilic monomers include monomers having a hydroxyl group at the ends thereof and monomers having an ester bond in the molecule thereof. Among them, ester monomers are preferred from the viewpoint of being resistant to environmental changes.

The ester monomer is not particularly limited and may be appropriately selected depending on the intended purpose. Examples thereof include vinyl acetate, vinyl butyrate, vinyl propionate, vinyl butyrate, diallyl phthalate, diallyl adipate, isopropenyl acetate, vinyl methacrylate, methyl-4-vinylbenzoate, cyclohexyl methacrylate, vinyl methoxyacetate, ethyl-α-ethoxyacrylate, alkyl (meth)acrylates having a C1 to C50 alkyl group, dialkyl fumarates (where each of the two alkyl groups is a C2 to C8 linear, branched or alicyclic group), dialkyl maleates (where each of the two alkyl groups is a C2 to C8 linear, branched or alicyclic group), poly(meth)allyloxyalkanes, vinyl monomers having a polyalkylene glycol chain, and poly(meth)acrylates of polyhydric alcohols.

The amount of the ester monomer forming the charge-controlling resin particles is preferably 20% by mass or more, more preferably 40% by mass to 80% by mass, in consideration of the compatibility between the base resin and the charge-controlling resin particles and the average embedment rate of the charge-controlling resin particles. When it is less than 20% by mass, the compatibility between the base resin and the charge-controlling resin particles decrease, so that the average embedment rate of the charge-controlling resin particles may decrease.

The mass ratio of the styrene monomer to the ester monomer (styrene monomer/ester monomer) depends on the type of the polyester resin used but is preferably about 30/70 to about 60/40. When the mass ratio thereof is less than 30/70, the charging property of the charge-controlling resin particles may be degraded. Whereas when it is more than 60/40, the charge-controlling resin particles tend to protrude from the toner surface. When the charge-controlling resin particles protrude from the toner surface, the charge-controlling resin particles may be exfoliated during the toner production process or due to stirring in a developing device, so that the effect of the present invention cannot be obtained at a part for regulating the amount of the toner.

The state where the charge-controlling resin particles are embedded in the toner surface or protrude from the toner surface is evaluated based on the embedment rate. In the toner of the present invention, the average embedment rate is 90% or higher, preferably 92% or higher, more preferably 95% or higher. When the average embedment rate is less than 90%, the charge-controlling resin particles are easily exfoliated from the toner surface, so that the charging property cannot be retained or the low-temperature fixing property is degraded.

The average embedment rate can be measured as follows. Specifically, one toner particle is sliced with an ultramicrotome (product of Ultrasonic Co.) to prepare a thin section of the toner particle. Then, the thin section is observed under a scanning transmission electron microscope (STEM). The obtained cross-sectional image is used to calculate embedment rates of the charge-controlling resin particles in one toner particle. The same procedure is performed on a plurality of toner particles, preferably 20 or more toner particles, to thereby calculate the embedment rates. The embedment rates in the plurality of toner particles can be averaged to calculate the average embedment rate. Here, by using image processing software, it is possible to measure the total area of each charge-controlling resin particle embedded in and attached onto the base resin and the area of a part embedded in the base resin (core). The thus-measured areas are used to calculate the embedment rate which is a percentage of the embedded part relative to the total area. Regarding the particle diameter of the charge-controlling resin particles as being sufficiently smaller than that of the core, the boundaries between the exposed regions and the embedded regions of the resin particles are approximated by plane.

—Charge-Controlling Agent—

The charge controlling agent is not particularly limited and may be appropriately selected depending on the intended purpose. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives.

The charge controlling agent may be synthesized appropriately or may be a commercially available product. Examples of the commercially available product include nigrosine dye BONTRON 03, quaternary ammonium salt BONTRON P-51, metal-containing azo dye BONTRON S-34, oxynaphthoic acid metal complex BONTRON E-82, salicylic acid metal complex BONTRON E-84, salicylic acid zinc complex BONTRON E-304 and phenol condensate BONTRON E-89 (these products are of ORIENT CHEMICAL INDUSTRIES CO., LTD), quaternary ammonium salt molybdenum complexes TP-302 and TP-415, and salicylic acid zirconia complex TN-105 (these products are of Hodogaya Chemical), quaternary ammonium salt COPY CHARGE PSY VP2038, triphenylmethane derivative COPY BLUE PR, quaternary ammonium salt COPY CHARGE NEG VP2036 and COPY CHARGE NX VP434 (these products are of Hoechst AG), LRA-901 and organic boron complex LR-147 (these products are of Japan Carlit), copper phthalocyanine, perylene, quinacridone, azo pigments, and polymeric compounds having a functional group such as a sulfonic acid group, a carboxyl group and/or a quaternary ammonium salt. These may be used alone or in combination. Among them, the compounds that negatively charge toner particles are particularly preferably used. Specifically, salicylic acid zinc complexes, salicylic acid zirconium complexes and organic boron complexes are preferred, with salicylic acid zinc complexes being particularly preferred.

<Other Components>

<<Inorganic Dispersing Agent>>

The inorganic dispersing agent is not particularly limited and may be appropriately selected depending on the intended purpose. Examples thereof include tricalcium phosphate, magnesium phosphate, aluminum phosphate, zinc phosphate, magnesium carbonate, calcium hydroxide, magnesium hydroxide, aluminum hydroxide, calcium metasilicate, calcium sulfate, barium sulfate, bentonite, alumina, calcium carbonate, titanium oxide, colloidal silica and hydroxyapatite. These may be used alone or in combination.

<<Releasing Agent>>

The releasing agent (wax) used in the present invention is not particularly limited and may be appropriately selected depending on the intended purpose. Examples thereof include polyolefin waxes (e.g., polyethylene wax and polypropylene wax); long-chain hydrocarbons (e.g., paraffin waxes, Fischer-Tropsch waxes and SASOL wax); and carbonyl group-containing waxes.

Examples of the carbonyl group-containing waxes include polyalkanoic acid esters (e.g., carnauba wax, montan wax, trimethylolpropane tribehenate, pentaerythritol tetrabehenate, pentaerythritol diacetatedibehenate, glycerine tribehenate and 1,18-octadecanediol distearate); polyalkanol esters (e.g., tristearyl trimellitate and distearyl malleate); polyalkanoic acid amides (e.g., ethylenediamine dibehenylamide); polyalkylamides (e.g., trimellitic acid tristearylamide); and dialkyl ketones (e.g., distearyl ketone).

Among them, since they have lower polarity and lower melt viscosity, polyolefin waxes and long-chain hydrocarbons are preferred, with paraffin waxes and Fischer-Tropsch waxes being more preferred. These may be used alone or in combination.

<<Wax-Dispersing Agent>>

The wax-dispersing agent is not particularly limited and may be appropriately selected depending on the intended purpose. Examples thereof include: block polymers or oligomers formed between units highly compatible to wax and units highly compatible to resin; graft polymers or oligomers formed between units highly compatible to wax and units highly compatible to resin; copolymers formed between unsaturated hydrocarbons (e.g., ethylene, propylene, butene, styrene and α-styrene) and α,β-unsaturated carboxylic acids, esters thereof or anhydrides thereof (e.g., acrylic acid, methacrylic acid, maleic acid, maleic anhydride, itaconic acid and itaconic anhydride); and block or graft polymers formed between vinyl resins and polyester resins. These may be used alone or in combination.

Examples of the units highly compatible to wax include long-chain alkyl groups having 12 or more carbon atoms, and copolymers formed between such long-chain alkyl groups and polyethylene, polypropylene, polybutene or polybutadiene. Examples of the units highly compatible to resin include polyester resins and vinyl resins.

The average embedment rate of the charge-controlling resin particles in the toner particles can be adjusted using the wax-dispersing agent. For example, using a wax-dispersing agent having a similar structure to that of the charge-controlling resin particles can increase the average embedment rate of the charge-controlling resin particles. Also, increasing the amount of the wax-dispersing agent used can further increase the average embedment rate thereof.

<<Colorant>>

The toner of the present invention may contain known colorants conventionally used for full-color toners. Examples of the colorant include carbon black, aniline blue, carcoil blue, chromium yellow, ultramarine blue, Du Pont oil red, quinoline yellow, methylene blue chloride, copper phthalocyanine, malachite green oxalate, lamp black, rose bengal, C.I. pigment red 48:1, C.I. pigment red 122, C.I. pigment red 57:1, C.I. pigment red 184, C.I. pigment yellow 97, C.I. pigment yellow 12, C.I. pigment yellow 17, C.I. pigment yellow 74, C.I. solvent yellow 162, C.I. pigment yellow 180, C.I. pigment yellow 185, C.I. pigment blue 15:1 and C.I. pigment blue 15:3. These may be used alone or in combination.

The amount of the colorant contained in each toner particle is not particularly limited and may be appropriately selected depending on the intended purpose. It is preferably 2 parts by mass to 15 parts by mass per 100 parts by mass of all of the resin components.

From the viewpoint of its dispersibility, the colorant is preferably used in the form of masterbatch where it is dispersed in a resin mixture containing the resins used. The amount of the masterbatch added is not particularly limited so long as the amount of the colorant contained falls within the above range.

The amount of the colorant contained in the masterbatch is not particularly limited and may be appropriately selected depending on the intended purpose. It is preferably 20% by mass to 40% by mass.

(Method for Producing Toner)

A method of the present invention for producing a toner includes at least an oil phase preparation step, an aqueous phase preparation step, a charge-controlling resin particles addition step, and a toner base particles preparation step; and, if necessary, further includes other steps such as a desolvation step, a washing step, a drying step, an aging step, and an external addition step.

The method of the present invention is preferably based on the dissolution suspension method, with which it is easy to produce a toner having such a structure as that of the toner of the present invention.

In one exemplary method for producing a toner based on the dissolution suspension method, a toner composition containing at least a resin for forming the base resin and a colorant is dissolved or dispersed in an organic solvent to prepare a solution or dispersion liquid; the resultant solution or dispersion liquid is dispersed in an aqueous solvent in the presence of a dispersing agent using, for example, an usual stirrer, homomixer or homogenizer so that the formed toner particles can have a desired particle size distribution; and the organic solvent is removed to obtain a toner slurry. The toner can be isolated by a known process including: collecting through washing and filtrating; and drying. Each step of this method will next be described referring to a flowchart depicted in FIG. 4.

<Oil Phase Preparation Step>

The oil phase preparation step is a step of preparing an oil phase where at least a resin and a colorant are dissolved or dispersed in an organic solvent. The oil phase may be prepared in the following manner. Specifically, the base resin, the colorant, and other materials are gradually added to the organic solvent under stirring so that these materials are dissolved or dispersed therein. Notably, when a pigment is used as the colorant and/or when the releasing agent and the charge controlling agent used are poorly dissolvable to the organic solvent, the particles of these materials are preferably micronized before the addition to the organic solvent.

The resin suitably usable is the above resin for forming the base resin. The colorant suitably usable is the above colorants.

In another means, when dispersing the materials melted at a temperature lower than the boiling point of the organic solvent, they are heated under stirring in the organic solvent, if necessary in the presence of a dispersion aid to be stirred together with the dispersoids; and the resultant solution is cooled with stirring or shearing so that the dissolved materials are crystallized, to thereby produce microcrystals of the dispersoids.

After the colorant and the releasing agent have been dissolved or dispersed in the organic solvent together with the resin using any of the above means, the resultant solution or dispersion liquid may further be dispersed. The dispersion may be performed using a known disperser such as a bead mill or a disc mill.

—Organic Solvent—

The organic solvent used is preferably an organic solvent having a boiling point lower than 100° C. from the viewpoint of allowing easy removal. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used alone or in combination.

<Aqueous Phase Preparation Step>

The aqueous phase preparation step is a step of preparing an aqueous phase containing an aqueous medium.

The aqueous medium may be water alone or a mixture of water and a water-miscible solvent. Examples of the water-miscible solvent include alcohols (e.g., methanol, isopropanol and ethylene glycol), dimethylformamide, tetrahydrofuran, cellosolves (e.g., methyl cellosolve) and lower ketones (e.g., acetone and methyl ethyl ketone). The amount of the aqueous medium is generally 50 parts by mass to 2,000 parts by mass, preferably 100 parts by mass to 1,000 parts by mass, per 100 parts by mass of the toner materials. Use of the aqueous medium in an amount of less than 50 parts by mass may lead to degradation in the dispersion state of the toner materials. Use of the aqueous medium in an amount of more than 2,000 parts by mass is not economical.

The aqueous medium may contain a surfactant for improving dispersibility of the oil phase. The surfactant is not particularly limited and may be appropriately selected depending on the intended purpose. From the viewpoint of efficiently dispersing the oil droplets containing the solvent, the surfactant used is preferably a disulfonic acid salt having a high HLB. The amount of the surfactant contained in the aqueous medium is preferably 1% by mass to 10% by mass, more preferably 2% by mass to 8% by mass, particularly preferably 3% by mass to 7% by mass. When the amount thereof is more than 10% by mass, each oil droplet becomes too small and/or has a reverse micellar structure. Thus, the dispersion stability is degraded due to the surfactant added in such an amount and as a result coarse oil droplets may be formed in some cases. Whereas when the amount thereof is less than 1% by mass, the oil droplets cannot be stably dispersed and as a result coarse oil droplets may be formed.

<Charge-Controlling Resin Particles Addition Step>

The charge-controlling resin particles addition step is a step of adding the charge-controlling resin particles. The addition of the charge-controlling resin particles is performed in the following manners (1) and (2), for example.

Figure 4A:
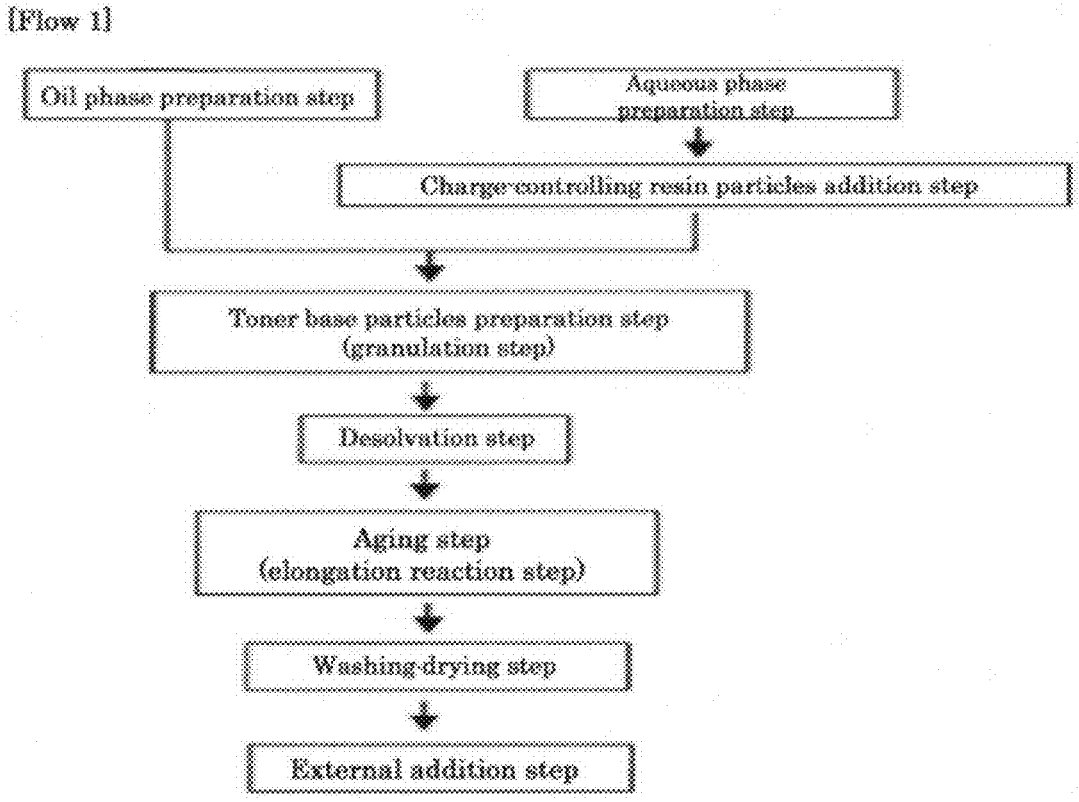
FIG. 4A is a flowchart of one production process of a toner of the present invention.

(1) The charge-controlling resin particles are added in advance to the aqueous phase in the aqueous phase preparation step (see [Flow 1] of FIG. 4A).

Figure 4B:
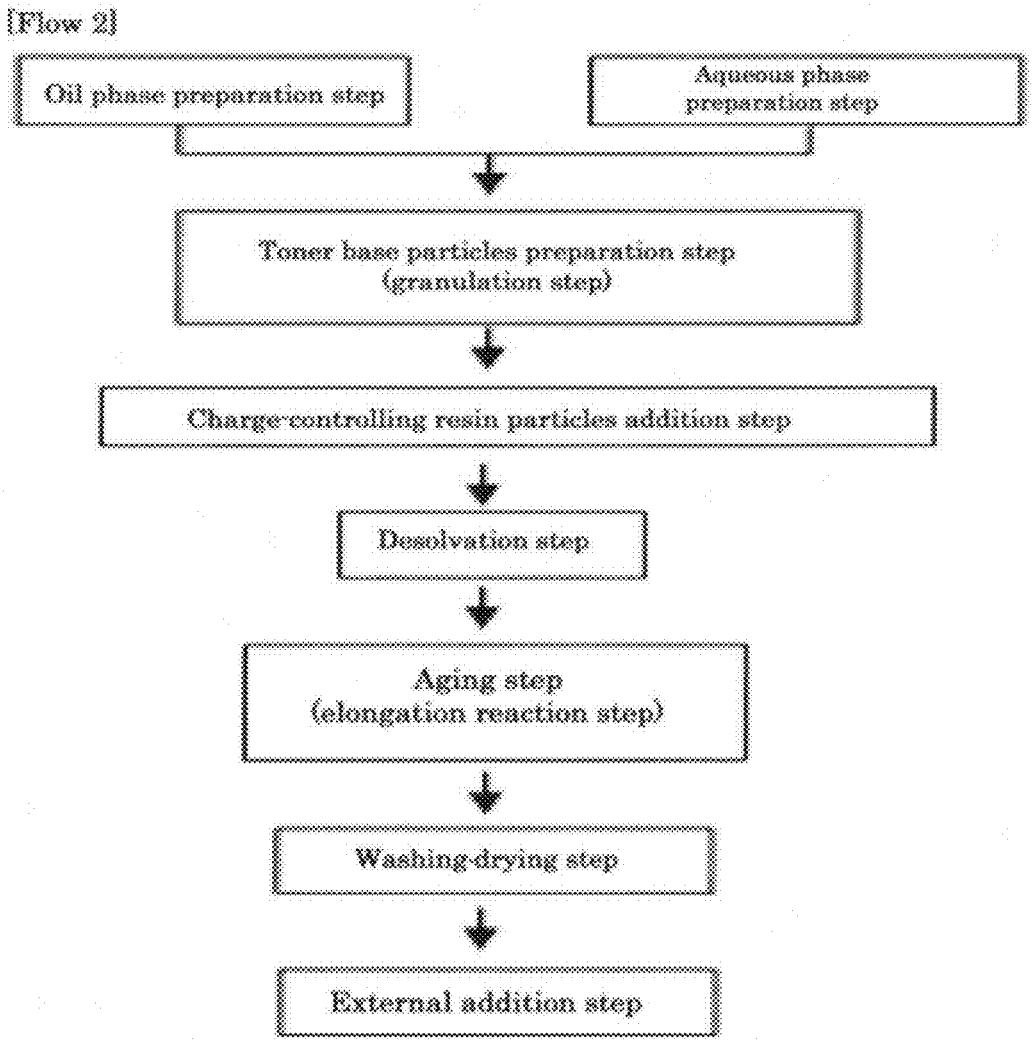
FIG. 4B is a flowchart of another production process of a toner of the present invention.

(2) The charge-controlling resin particles are added after the oil phase has been dispersed in the aqueous phase in the toner base particles preparation step (see [Flow 2] of FIG. 4B).

Through the process of (1) or (2), the charge-controlling resin particles can exist on the surfaces of the toner particles, resulting in that the charge-controlling agent can effectively be located in the surface layer of the toner particles.

Notably, the method for dispersing the charge-controlling agent into the charge-controlling resin particles is not particularly limited and may be appropriately selected depending on the intended purpose. For example, it is a method where monomers for synthesizing a resin are previously dispersed, followed by polymerization reaction so that the resin incorporates dispersoids of a charge-controlling agent; or a method where a charge-controlling agent is dispersed in charge-controlling resin particles through melt-kneading, and the resultant product is formed into predetermined particles by the phase-transfer method, the melt-kneading method or the emulsification aggregation method.

<Toner Base Particles Preparation Step>

The toner base particles preparation step is a step of dispersing the oil phase in the aqueous phase to prepare a dispersion liquid where toner base particles formed of the oil phase are dispersed.

The method for dispersing it is not particularly limited and may be appropriately selected depending on the intended purpose. It is preferably a high-shearing application method from the viewpoint of controlling the particle diameter of the dispersoids within the range of 2 μm to 20 μm. In this step, the resin is a base resin for toner, which has a structure containing the charge-controlling resin particles in the surface layer thereof.

The time for which the dispersion is performed is not particularly limited and may be appropriately selected depending on the intended purpose. It is generally 0.1 min to 5 min in a batch method. When the time for which the dispersion is performed is shorter than 0.1 min, the dispersion cannot sufficiently be performed in some cases. Whereas when it is longer than 5 min, unwanted small particles remain and the dispersion is excessively performed to make the dispersion system unstable, potentially forming aggregates and coarse particles. The temperature at which the dispersion is generally 0° C. to 40° C., preferably 10° C. to 30° C. When it is higher than 40° C., molecular movements are excited to degrade dispersion stability, easily forming aggregates and coarse particles. Whereas when it is lower than 0° C., the dispersion liquid is increased in viscosity to require elevated shearing energy for dispersion, leading to a drop in production efficiency.

<Other Steps>

<<Desolvation Step>>

The desolvation step is a step of removing the organic solvent. In one employable means for removing the organic solvent from the dispersoids of toner particles, the entire system can be gradually increased in temperature with stirring, to thereby completely evaporate off the organic solvent contained in the liquid droplets.

In another employable means, the obtained toner particle dispersoids under stirring are sprayed toward a dry atmosphere, to thereby completely evaporate off the organic solvent contained in the liquid droplets. In still another employable means, the toner particle dispersoids are reduced in pressure with stirring to evaporate off the organic solvent. The latter two means may be used in combination with the first means.

The dry atmosphere toward which the emulsified dispersion liquid is sprayed generally uses heated gas (e.g., air, nitrogen, carbon dioxide and combustion gas), especially, gas flow heated to a temperature equal to or higher than the highest boiling point of the solvents used. By removing the organic solvent even in a short time using, for example, a spray dryer, a belt dryer or a rotary kiln, the resultant product can have satisfactory qualities.

<<Aging Step>>

The aging step is a step of allowing elongation/crosslinking reaction of the isocyanate to proceed when a modified resin having an end isocyanate group is used as the resin. The time for which the aging is performed is generally 10 min to 40 hours, preferably 2 hours to 24 hours. The reaction temperature for the aging is generally 0° C. to 65° C., preferably 35° C. to 50° C.

<<Washing Step>>

The washing step is a step of washing toner particles obtained through the previous steps. The dispersion liquid of the toner particles obtained in the above-described manner contains not only the toner particles but also such subsidiary materials as the dispersing agent such as the surfactant. Thus, the dispersion liquid is washed to separate the toner particles from the subsidiary materials.

The method for washing the toner particles is not particularly limited and may be appropriately selected depending on the intended purpose. Examples thereof include a centrifugation method, a reduced-pressure filtration method and a filter press method.

Any of the above methods forms a cake of the toner particles. If the toner particles are not sufficiently washed through only one washing process, the formed cake may be dispersed again in an aqueous solvent to form a slurry, which is repeatedly treated with any of the above methods to taken out the toner particles. When a reduced-pressure filtration method or a filter press method is employed for washing, an aqueous solvent may be made to penetrate the cake to wash out the subsidiary materials contained in the toner particles.

The aqueous solvent used for washing is not particularly limited and may be appropriately selected depending on the intended purpose. Examples thereof include water or a solvent mixture of water and an alcohol such as methanol or ethanol. Use of water is preferred from the viewpoint of reducing cost and environmental load caused by, for example, drainage treatment.

<<Drying Step>>

The drying step is a step of drying the toner particles. Since the washed toner particles contain the aqueous medium in a large amount, they are preferably dried to remove the aqueous medium so that only toner particles can be obtained.

The drying can be performed using, for example, a spray dryer, a vacuum freezing dryer, a reduced-pressure dryer, a ventilation shelf dryer, a movable shelf dryer, a fluidized-bed-type dryer, a rotary dryer or a stirring-type dryer.

The toner particles are preferably dried until the water content is finally decreased less than 1% by mass.

Also, when the dry toner particles flocculate to cause inconvenience in use, the flocculated particles may be separated from each other through beating using, for example, a jet mill, HENSCHEL MIXER, a super mixer, a coffee mill, an oster blender or a food processor.

<<External Addition Step>>

The external addition step is a step of externally adding other particles to the toner particles. When the other particles such as fluidizing fine particles are mixed with the obtained dry toner particles, followed by application of mechanical impact to the powder mixture for the other particles to be immobilized and fused on the surface of each particle, the other particles can be prevented from being exfoliated from the surfaces of the obtained composite particles.

Specifically, the above treatment is performed by, for example, a method where impact is applied to the mixture using a rapidly rotating impellor. The apparatus usable is, for example, HENSCHEL MIXER (product of Mitsui Mining Co., Ltd.) or SUPER MIXER (product of KAWATA MFG CO., Ltd.).

(Image Forming Apparatus)

An image forming apparatus of the present invention includes an electrostatic image bearing member, a latent electrostatic image forming unit, a developing unit, a transfer unit and a fixing unit; and, if necessary, further includes appropriately selected other units such as a charge-eliminating unit, a cleaning unit, a recycling unit and a controlling unit. In this image forming apparatus, the developing unit must use as a developer the above-described toner of the present invention.

<Latent Electrostatic Image Forming Unit>

The latent electrostatic image forming unit is a unit configured to form a latent electrostatic image on an electrostatic image bearing member.

<Developing Unit>

The developing unit is a unit configured to develop the latent electrostatic image formed on the electrostatic image bearing member with a developer to form a visible image. The developer used in the developing step is the above-described toner of the present invention.

The formation of the visible image through development is performed in the following manner. Specifically, a toner layer is formed on a developing roller serving as a developer bearing member. Then, the toner layer on the developing roller is conveyed so as to be in contact with a photoconductor drum serving as the electrostatic image bearing member, to thereby develop the latent electrostatic image on the photoconductor drum.

<Transfer Unit>

The transfer unit is a unit configured to transfer the visible image formed on the electrostatic image bearing member to a recording medium.

Notably, a primary transfer unit and a secondary transfer unit may collectively be referred to as the transfer unit. The primary transfer unit is a unit configured to transfer the visible image formed on the electrostatic image bearing member to an intermediate transfer member by a primary transfer device. The secondary transfer unit is a unit configured to transfer the transferred visible image from the intermediate transfer member to a recording medium by a secondary transfer device.

<Fixing Unit>

The fixing unit is a unit configured to fix the transferred visible image on the recording medium.

The fixation of the transferred visible image is performed by fixing the transferred visible image on the recording medium with the fixing unit including a heating and pressing member. This fixation may be performed every time when each color toner is transferred onto the recording medium, or may be performed at one time on a composite toner image made of all color toners laminated.

The fixing unit is not particularly limited and may be appropriately selected depending on the intended purpose. It is preferably a known heating and pressing member. Examples of the heating and pressing member include a combination of a heating roller and a pressing roller and a combination of a heating roller, a pressing roller and an endless belt. One specific example of such fixing unit includes: a heating roller that is formed of a magnetic metal and is heated by electromagnetic induction; a fixation roller disposed parallel to the heating roller; an endless belt-like toner heating medium (a heating belt) that is taken across the heating roller and the fixation roller, is heated by a heating roller, and is rotated by these rollers; and a pressure roller that is brought into pressure contact with the fixation roller through the heating belt and is rotated in a forward direction relative to the heating belt to form a fixation nip part. With this configuration, it is possible to realize a temperature rise in the fixation belt in a short time and realize stable temperature control. Furthermore, even when a recording medium having a rough surface is used, during the fixation, the fixation belt acts in conformity to the surface of recording paper to some extent and, consequently, satisfactory fixability can be realized.

EXAMPLES

The present invention will next be described in detail by way of Examples and Comparative Examples. However, the present invention should not be construed as being limited the Examples.

<Synthesis of Resin 1>

A reaction container equipped with a condenser, a stirrer and a nitrogen-introducing pipe was charged with bisphenol A ethylene oxide 2 mol adduct (264 parts by mass), bisphenol A propylene oxide 2 mol adduct (523 parts by mass), terephthalic acid (123 parts by mass), adipic acid (173 parts by mass) and dibutyl tinoxide (1 part by mass), followed by reaction at 230° C. for 8 hours under normal pressure. Next, the reaction mixture was allowed to react for 8 hours at a reduced pressure of 10 mmHg to 15 mmHg. Then, trimellitic anhydride (26 parts by mass) was added to the reaction container, followed by reaction at 180° C. for 2 hours under normal pressure, to thereby obtain [resin 1]. The thus-obtained [resin 1] was found to have a glass transition temperature of 65° C. and an acid value of 12 mgKOH/g.

Notably, the glass transition temperature of a resin was measured as follows using a differential scanning calorimeter (e.g., DSC-6220R; product of Seiko Instruments Inc.). Specifically, the resin was heated from room temperature to 150° C. at a temperature increasing rate of 10° C./min, followed by being left to stand at 150° C. for 10 min. The sample was cooled to room temperature and left to stand for 10 min. Again, the sample was heated to 150° C. at a temperature increasing rate of 10° C./min. In the obtained DSC curve, the glass transition temperature was determined as the intersection formed between the base line at a temperature equal to or lower than the glass transition temperature, and the tangential line of the curve representing glass transition.

The acid value of a resin was measured according to JIS K2501 and the hydroxyl value thereof was measured according to JIS K1557-1.

<Synthesis of Resin 2>

A reaction container equipped with a condenser, a stirrer and a nitrogen-introducing pipe was charged with bisphenol A ethylene oxide 2 mol adduct (240 parts by mass), bisphenol A propylene oxide 3 mol adduct (529 parts by mass), terephthalic acid (208 parts by mass), adipic acid (46 parts by mass) and dibutyl tinoxide (2 parts by mass), followed by reaction at 230° C. for 8 hours under normal pressure. Next, the reaction mixture was allowed to react for 5 hours at a reduced pressure of 10 mmHg to 15 mmHg. Then, trimellitic anhydride (44 parts by mass) was added to the reaction container, followed by reaction at 180° C. for 2 hours under normal pressure, to thereby obtain [resin 2]. The thus-obtained [resin 2] was found to have a glass transition temperature of 47° C. and an acid value of 25 mgKOH/g.

<Synthesis of Resin 3>

A reaction container equipped with a condenser, a stirrer and a nitrogen-introducing pipe was charged with sodium dodecyl sulfate (0.3 parts by mass) and ion-exchange water (200 parts by mass), followed by heating to 80° C. under stirring for dissolution. Then, a solution of potassium persulfate (1.3 parts by mass) in ion-exchange water (51 parts by mass) was added to the resultant solution. Fifteen minutes after the addition, a monomer mixture of a styrene monomer (30 parts by mass), n-butyl acrylate (40 parts by mass), methacrylic acid (30 parts by mass) and n-octanethiol (3.2 parts by mass) was added dropwise to the resultant mixture for 90 min. Subsequently, the temperature of the mixture was maintained at 80° C. for 60 min to perform polymerization reaction.

Then, the reaction mixture was cooled to obtain white [resin 3] having a volume average particle diameter of 110 nm. The obtained [resin 3] was found to have a glass transition temperature of 84° C. Notably, the particle diameter of a resin (volume average particle diameter) was measured using UPA-150EX (product of NIKKISO CO., LTD.).

<Synthesis of Resin 4>

The procedure for the synthesis of [resin 3] was repeated, except that the monomer mixture was changed to a monomer mixture prepared as follows, to thereby obtain [resin 4].

Specifically, 10 parts by mass of BONTORON E-304 (product of ORIENT CHEMICAL INDUSTRIES CO., LTD) serving as a charge-controlling agent was added under stirring/mixing to a mixture containing 30 parts by mass of a styrene monomer, 40 parts by mass of n-butyl acrylate, 30 parts by mass of methacrylic acid, and 3.2 parts by mass of n-octanethiol, followed by mixing for 15 min. The resultant mixture was ultrasonically dispersed for 10 min to prepare the monomer mixture.

<Synthesis of Resin 5>

A reaction container equipped with a condenser, a stirrer and a nitrogen-introducing pipe was charged with sodium dodecyl sulfate (0.3 parts by mass) and ion-exchange water (250 parts by mass), followed by heating to 80° C. under stirring for dissolution. Then, a solution of potassium persulfate (1.3 parts by mass) in ion-exchange water (52 parts by mass) was added to the resultant solution. Fifteen minutes after the addition, a monomer mixture of a styrene monomer (20 parts by mass), n-butyl acrylate (40 parts by mass), methacrylic acid (40 parts by mass) and n-octanethiol (2.1 parts by mass) was added dropwise to the resultant mixture for 90 min. Subsequently, the temperature of the mixture was maintained at 80° C. for 60 min to perform polymerization reaction.

Then, the reaction mixture was cooled to obtain white [resin 5] having a volume average particle diameter of 100 nm. The obtained [resin 5] was found to have a glass transition temperature of 80° C.

<Synthesis of Resin 6-1>

The procedure for the synthesis of [resin 5] was repeated, except that the monomer mixture was changed to a monomer mixture prepared as follows, to thereby obtain [resin 6-1] having a volume average particle diameter of 100 nm.

Specifically, 10 parts by mass of BONTORON E-304 (product of ORIENT CHEMICAL INDUSTRIES CO., LTD) serving as a charge-controlling agent was added under stirring/mixing to a mixture containing 20 parts by mass of a styrene monomer, 40 parts by mass of n-butyl acrylate, 40 parts by mass of methacrylic acid and 2.1 parts by mass of n-octanethiol, followed by mixing for 15 min. The resultant mixture was ultrasonically dispersed for 10 min to prepare the monomer mixture.

<Synthesis of Resin 6-2>

The procedure for the synthesis of [resin 6-1] was repeated, except that the amount of sodium dodecyl sulfate was changed from 0.3 parts by mass to 0.2 parts by mass, to thereby obtain [resin 6-2] having a volume average particle diameter of 150 nm <Synthesis of Resin 6-3>

The procedure for the synthesis of [resin 6-1] was repeated, except that the amount of sodium dodecyl sulfate was changed from 0.3 parts by mass to 0.7 parts by mass, to thereby obtain [resin 6-3] having a volume average particle diameter of 50 nm.

<Synthesis of Resin 6-4>

The procedure for the synthesis of [resin 6-1] was repeated, except that the amount of sodium dodecyl sulfate was changed from 0.3 parts by mass to 0.15 parts by mass, to thereby obtain [resin 6-4] having a volume average particle diameter of 200 nm.

<Synthesis of Resin 7>

The procedure for the synthesis of [resin 5] was repeated, except that the monomer mixture was changed to a monomer mixture prepared as follows, to thereby obtain [resin 7].

Specifically, 10 parts by mass of TN-105 (product of Hodogaya Chemical Co., Ltd.) serving as a charge-controlling agent was added under stirring/mixing to a mixture containing 20 parts by mass of a styrene monomer, 40 parts by mass of n-butyl acrylate, 40 parts by mass of methacrylic acid and 2.1 parts by mass of n-octanethiol, followed by mixing for 15 min. The resultant mixture was ultrasonically dispersed for 10 min to prepare the monomer mixture.

<Synthesis of Resin 8>

The procedure for the synthesis of [resin 5] was repeated, except that the monomer mixture was changed to a monomer mixture prepared as follows, to thereby obtain [resin 8].

Specifically, 10 parts by mass of LR-147 (product of Japan Carlit Co., Ltd.) serving as a charge-controlling agent was added under stirring/mixing to a mixture containing 20 parts by mass of a styrene monomer, 40 parts by mass of n-butyl acrylate, 40 parts by mass of methacrylic acid and 2.1 parts by mass of n-octanethiol, followed by mixing for 15 min. The resultant mixture was ultrasonically dispersed for 10 min to prepare the monomer mixture.

<Synthesis of Resin 9>

A reaction container equipped with a condenser, a stirrer and a nitrogen-introducing pipe was charged with sodium dodecyl sulfate (0.3 parts by mass) and ion-exchange water (250 parts by mass), followed by heating to 80° C. under stirring for dissolution. Then, a solution of potassium persulfate (1.3 parts by mass) in ion-exchange water (50 parts by mass) was added to the resultant solution. Fifteen minutes after the addition, a monomer mixture of a styrene monomer (40 parts by mass), n-butyl acrylate (40 parts by mass), methacrylic acid (20 parts by mass) and n-octanethiol (2 parts by mass) was added dropwise to the resultant mixture for 90 min. Subsequently, the temperature of the mixture was maintained at 80° C. for 60 min to perform polymerization reaction.

Then, the reaction mixture was cooled to obtain white [resin 9] having a volume average particle diameter of 100 nm. The obtained [resin 9] was found to have a glass transition temperature of 57° C.

<Synthesis of Resin 10>

A reaction container equipped with a condenser, a stirrer and a nitrogen-introducing pipe was charged with sodium dodecyl sulfate (0.3 parts by mass) and ion-exchange water (250 parts by mass), followed by heating to 80° C. under stirring for dissolution. Then, a solution of potassium persulfate (1.3 parts by mass) in ion-exchange water (53 parts by mass) was added to the resultant solution. Fifteen minutes after the addition, a monomer mixture was added dropwise to the resultant mixture for 90 min, and the temperature of the mixture was maintained at 80° C. for 60 min to perform polymerization reaction. Here, the monomer mixture which was added dropwise above had been prepared as follows: 10 parts by mass of BONTORON E-304 (product of ORIENT CHEMICAL INDUSTRIES CO., LTD) serving as a charge-controlling agent was added under stirring/mixing to a mixture containing 92.5 parts by mass of a styrene monomer, 7.5 parts by mass of methoxydiethylene glycol methacrylate and 2.1 parts by mass of n-octanethiol, followed by mixing for 15 min, the resultant mixture was ultrasonically dispersed for 10 min to prepare the monomer mixture.

Then, the mixture obtained after the polymerization reaction was cooled to obtain white [resin 10] having a volume average particle diameter of 110 nm. The obtained [resin 10] was found to have a glass transition temperature of 70° C.

<Synthesis of Resin 11>

A reaction container equipped with a condenser, a stirrer and a nitrogen-introducing pipe was charged with sodium dodecyl sulfate (0.3 parts by mass) and ion-exchange water (250 parts by mass), followed by heating to 80° C. under stirring for dissolution. Then, a solution of potassium persulfate (1.2 parts by mass) in ion-exchange water (49 parts by mass) was added to the resultant solution. Fifteen minutes after the addition, a monomer mixture was added dropwise to the resultant mixture for 90 min, and the temperature of the mixture was maintained at 80° C. for 60 min to perform polymerization reaction. Here, the monomer mixture which was added dropwise above had been prepared as follows: 10 parts by mass of BONTORON E-304 (product of ORIENT CHEMICAL INDUSTRIES CO., LTD) serving as a charge-controlling agent was added under stirring/mixing to a mixture containing 28.8 parts by mass of a styrene monomer, 38.5 parts by mass of n-butyl acrylate, 28.8 parts by mass of methacrylic acid, 3.85 parts by mass of methoxydiethylene glycol methacrylate and 2 parts by mass of n-octanethiol, followed by mixing for 15 min, and the resultant mixture was ultrasonically dispersed for 10 min to prepare the monomer mixture.

Then, the mixture obtained after the polymerization reaction was cooled to obtain white [resin 11] having a volume average particle diameter of 90 nm. The obtained [resin 11] was found to have a glass transition temperature of 77° C.

<Synthesis of Resin 12>

A reaction container equipped with a condenser, a stirrer and a nitrogen-introducing pipe was charged with sodium dodecyl sulfate (0.3 parts by mass) and ion-exchange water (250 parts by mass), followed by heating to 80° C. under stirring for dissolution. Then, a solution of potassium persulfate (1.2 parts by mass) in ion-exchange water (49 parts by mass) was added to the resultant solution. Fifteen minutes after the addition, a monomer mixture of a styrene monomer (27 parts by mass), n-butyl acrylate (36 parts by mass), methacrylic acid (27 parts by mass), 10 parts by mass of methoxydiethylene glycol methacrylate and n-octanethiol (2 parts by mass) was added dropwise to the resultant mixture for 90 min. Subsequently, the temperature of the mixture was maintained at 80° C. for 60 min to perform polymerization reaction.

Then, the reaction mixture was cooled to obtain white [resin 12] having a volume average particle diameter of 90 nm. The obtained [resin 12] was found to have a glass transition temperature of 65° C.

<Synthesis of Prepolymer 1>

A reaction container equipped with a condenser, a stirrer and a nitrogen-introducing pipe was charged with bisphenol A ethylene oxide 2 mol adduct (682 parts by mass), bisphenol A propylene oxide 2 mol adduct (81 parts by mass), terephthalic acid (283 parts by mass), trimellitic anhydride (22 parts by mass) and dibutyl tinoxide (2 parts by mass), followed by reaction at 230° C. for 8 hours under normal pressure. Next, the reaction mixture was allowed to react for 5 hours at a reduced pressure of 1.3 kPa to 2.0 kPa (10 mmHg to 15 mmHg), to thereby obtain [intermediate polyester 1]. The [intermediate polyester 1] was found to have a number average molecular weight of 2,100, a weight average molecular weight of 9,500, a glass transition temperature of 55° C., an acid value of 0.5 mgKOH/g and a hydroxyl value of 49 mgKOH/g.

Next, a reaction container equipped with a condenser, a stirrer and a nitrogen-introducing pipe was charged with the [intermediate polyester 1] (411 parts by mass), isophorone diisocyanate (89 parts by mass) and ethyl acetate (500 parts by mass), followed by reaction at 100° C. for 5 hours, to thereby obtain [prepolymer 1].

<Preparation of Masterbatch 1>

C.I. Pigment Yellow 74 (50 parts by mass), the resin 1 (50 parts by mass) and water (30 parts) were mixed together using HENSCHEL MIXER, to thereby obtain a mixture containing pigment aggregates impregnated with water. The obtained mixture was kneaded for 45 min with a two-roll mill whose roll surface temperature had been adjusted to 130° C. The kneaded product was pulverized with a pulverizer so as to have a size of 1 mm, whereby [masterbatch 1] was obtained.

Example 1

<Preparation of Aqueous Phase>

Ion-exchange water (970 parts by mass), 60 parts by mass of 25% by mass aqueous dispersion liquid of fine organic resin particles for stabilizing dispersion (a copolymer of styrene-methacrylic acid-butyl acrylate-sodium salt of methacrylic acid ethylene oxide adduct sulfuric acid ester), 180 parts by mass of 48.5% by mass aqueous solution of sodium dodecyl diphenyl ether disulfonate and 100 parts by mass of ethyl acetate were mixed together under stirring. The resultant mixture was found to have a pH of 6.2. Then, 10% by mass aqueous solution of sodium hydroxide was added dropwise thereto to adjust the pH to 9.5, whereby [aqueous phase 1] was obtained.

<WAX Dispersion Liquid Preparation Step>

A container to which a stirring rod and a thermometer had been set was charged with the [resin 1] (24 parts by mass), paraffin wax (melting point: 72° C.) (12 parts by mass), ethyl acetate (100 parts by mass) and styrene-polyethylene polymer (glass transition temperature: 72° C., number average molecular weight: 7,100) serving as a wax dispersing agent (8 parts by mass). The mixture was increased in temperature to 80° C. under stirring, maintained at 80° C. for 5 hours, and cooled to 30° C. for 1 hour. Using a bead mill ("ULTRA VISCOMILL," product of AIMEX CO., Ltd.) under the following conditions: a liquid feed rate of 1 kg/hr, disc circumferential velocity of 6 m/s, 0.5 mm-zirconia beads packed to 80% by volume, and 3 passes, the WAX was dispersed to obtain [WAX dispersion liquid 1].

<Oil Phase Preparation Step>

The [resin 1] (100 parts by mass), the [masterbatch 1] (18 parts by mass), the [WAX dispersion liquid 1] (30 parts by mass) and ethyl acetate (80 parts by mass) were mixed for 30 min at 8,000 rpm with a TK homomixer (product of Tokushu Kika Kogyo Co., Ltd.). Then, the [prepolymer 1] (15 parts by mass) was added to the mixture, followed by mixing for 2 min at 8,000 rpm with a TK homomixer, to thereby obtain [oil phase 1]. Through measurement, the solid content of the [oil phase 1] was found to be 60% by mass.

<Production Step of Toner Base Particles>

The [oil phase 1] (100 parts by mass) was added to the [aqueous phase 1] (100 parts by mass). The resultant mixture was mixed for 2 min with a TK homomixer at 3,000 rpm, while being adjusted to 20° C. to 23° C. in a water bath to suppress increase in temperature due to shear heat of the mixer. Thereafter, the mixture was stirred for 10 min at 250 rpm using a three-one motor equipped with an anchor wing, to thereby obtain [particle slurry 1] containing liquid droplets of the oil phase (which would be core particles) in the aqueous phase.

<Charge-Controlling Resin Particles Addition Step>

The [particle slurry 1] (200 parts by mass) was kept at 22° C. while being stirred at 350 rpm using a three-one motor equipped with an anchor wing. In this state, a dispersion liquid of the [resin 3] was added dropwise to the [particle slurry 1] for 3 min in an amount of 6.0 parts by mass per 100 parts by mass of the [resin 1]. The resultant mixture was stirred for 30 min to obtain [composite particle slurry 1].

<Desolvation Step>

The [composite particle slurry 1] was charged into a container to which a stirrer and a thermometer had been set. The [composite particle slurry 1] was then desolvated under stirring at 30° C. for 8 hours to obtain [dispersion slurry 1].

<Washing/Drying Step>

The [dispersion slurry 1] (100 parts by mass) was filtrated under reduced pressure. Then, the following treatments (1) to (4) were performed.

(1): Ion-exchange water (100 parts by mass) was added to the filtration cake, and the resultant mixture was stirred with a TK homomixer (at 12,000 rpm for 10 min), followed by filtrating.

(2): Ion-exchange water (900 parts by mass) was added to the filtration cake obtained in (1), and the resultant mixture was ultrasonically vibrated and mixed using a TK homomixer (at 12,000 rpm for 30 min), followed by filtrating under reduced pressure. This treatment was repeated until the reslurry had an electrical conductivity of 10 μC/cm or lower.

(3) 10% hydrochloric acid was added to the reslurry obtained in (2) so as to have a pH of 4, and the resultant mixture was stirred for 30 min with a three-one motor, followed by filtrating.

(4) Ion-exchange water (100 parts by mass) was added to the filtration cake obtained in (3), and the resultant mixture was mixed with a TK homomixer (at 12,000 rpm for 10 min), followed by filtrating. This treatment was repeated until the reslurry had an electrical conductivity of 10 μC/cm or lower, to thereby obtain [filtration cake 1].

The [filtration cake 1] was dried with an air-circulation dryer at 45° C. for 48 hours, and then sieved with a mesh having an opening size of 75 μm to obtain [toner base particles 1].

<External Addition Step>

2.5 parts by mass of fine inorganic particles TS530 (product of Cabozyl Co.) was added to 100 parts by mass of the [toner base particles 1]. The resultant mixture was mixed using HENSCHEL MIXER (speed: 40 m/s) for 10 min to obtain toner particles 1.

Examples 2 to 13 and Comparative Examples 1 to 6

The procedure of Example 1 was repeated, except that the combination of the [resin 1] and the [resin 3] was changed as shown in Table 1, to thereby obtain toner particles 2 to 13 and 15 to 20.

Example 14

The procedure of Example 3 was repeated, except that the charge-controlling resin particles were added to the aqueous phase before the production step of the toner base particles instead of the particle slurry after the production step of the toner base particles, to thereby obtain toner particles 14.

<Evaluation Method>

Each of the above-obtained toner particles 1 to 20 was evaluated in the following manner. The evaluation results are shown in Tables 2 and 3.

<<Particle Diameter of Toner>>

One employable measurement apparatus for the particle distribution of toner particles is a Coulter Counter TA-II, Coulter Multisizer II and Coulter Multisizer III (these products are of Coulter, Inc.). The measurement method will next be described.

First, a surfactant (0.1 mL to 5 mL), preferably an alkylbenzene sulfonic acid salt, was added as a dispersing agent to an aqueous electrolyte solution (100 mL to 150 mL). Here, the aqueous electrolyte solution is an about 1% by mass aqueous NaCl solution prepared using 1st grade sodium chloride, and ISOTON-II (product of Coulter, Inc.) was used as the aqueous electrolyte solution. In addition, a measurement sample in an amount of 2 mg to 20 mg based on the solid content thereof was suspended in the above aqueous electrolyte solution. The resultant electrolyte solution was dispersed with an ultrasonic wave disperser for about 1 min to about 3 min. The thus-obtained dispersion liquid was analyzed with the above-described apparatus using an aperture of 100 μm to measure the number or volume of the toner particles (or toner). Then, the volume particle size distribution and number particle size distribution were calculated from the obtained values. From these distributions, the volume average particle diameter (Dv) and number average particle diameter (Dp) of the toner were obtained.

In this measurement, 13 channels were used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) were subjected to the measurement.

<<Average Amount of Charge-Controlling Resin Particles Present in a Region 500 nm in Depth from the Surface of a Toner Particle>>

Toner particles were wrapped with an epoxy resin, and the resultant product was sliced with an ultramicrotome (product of Ultrasonic Co.) to prepare an 80-nm thick thin section of the toner particles, followed by staining with ruthenium tetraoxide. The stained thin section was observed under a scanning transmission electron microscope (STEM). The obtained cross-sectional image of the toner particles was used to measure the amount of island-shaped resin particles having different contrast in a region 500 nm in depth from the surface of each toner particle. The measurement was performed with the image analysis and particle size distribution measurement software MAC-VIEW (product of MOUNTECH Co., Ltd.). The samples used were 100 toner particles within ±10% of the volume average particle diameter of the toner particles. Each of the 100 toner particles was measured for the amount of the charge-controlling resin particles present in a region 500 nm in depth of the surface of the toner particle, and the obtained values were averaged and used for evaluation. In other words, the amount of the charge-controlling resin particles present in a region 500 nm in depth from the surface of the toner particle is measured based on a ratio of the total area of the charge-controlling resin particles present in this region relative to the total area of all the charge-controlling resin particles. Thus, regarding the charge-controlling resin particles present on the boundary of this region, the partial areas within the region, divided by the boundary, are taken into consideration for evaluation.

When the toner particle contained, for example, a wax and a charge-controlling agent, each of these materials was previously wrapped with the above epoxy resin to confirm the contrast of each material relative to the epoxy resin in addition to the contrast of the charge-controlling resin particles relative to the epoxy resin. In this manner, the amount of the charge-controlling resin particles only was measured. This was applied to all the below methods for observing the cross-section of the toner particle.

<<Average Embedment Rate of Charge-Controlling Resin Particles>>

Toner particles were wrapped with an epoxy resin, and the resultant product was sliced with an ultramicrotome (product of Ultrasonic Co.) to prepare an 80-nm thick thin section of the toner particles, followed by staining with ruthenium tetraoxide. The stained thin section was observed under a scanning transmission electron microscope (STEM). The obtained cross-sectional image of the toner particles was used to measure the embedment rates of 20 or more toner particles using the image analysis and particle size distribution measurement software MAC-VIEW (product of MOUNTECH Co., Ltd.) and the obtained embedment rates were averaged to calculate the average embedment rate.

The total area of each charge-controlling resin particle embedded in and attached onto the base resin and the area of a part embedded in the base resin (core) were measured, and the measured areas were used to calculate the embedment rate (i.e., the ratio of the area of the part to the total area). Regarding the particle diameter of the charge-controlling resin particles as being sufficiently smaller than that of the core, the boundaries between the exposed regions and the embedded regions of the resin particles were approximated by plane.

<<Evaluation of Charging Property of Charge-Controlling Resin Particles>>

0.25 g of charge-controlling resin particles and 4.75 g of carrier particles were placed in a stainless steel container having a height of 30 mm and having a bottom surface with a diameter of 25 mm. The resultant mixture was rotated in the circumferential direction at 200 rpm for 5 min, to thereby stir the charge-controlling resin particles and the carrier particles so as to be brought into contact therebetween. Here, the carrier particles used were ferrite particles having an average particle diameter of 35 nm (product of Ricoh Company Ltd.).

The thus-stirred charge-controlling resin particles were measured for charge amount per unit area (Q/S) by a blow-off method using the charge amount measuring device TB-200 (product of TOSHIBA CORPORATION).

Specifically, the measurement sample was placed on the sample portion of the above charge amount measuring device equipped with a 400-mesh (opening: 46 μm) stainless screen. Then, in the normal temperature, normal humidity environment (20° C., relative humidity: 55%), the measurement sample was blown by nitrogen gas for 10 sec at a blow pressure of 50 kPa (0.5 kgf/cm$^2$), followed by measurement of charges.

<<Average Equivalent Circle Diameter of Charge-Controlling Resin Particles>>

Toner particles were wrapped with an epoxy resin, and the resultant product was sliced with an ultramicrotome (product of Ultrasonic Co.) to prepare an 80-nm thick thin section of the toner particles, followed by staining with ruthenium tetraoxide. The stained thin section was observed under a scanning transmission electron microscope (STEM). The obtained cross-sectional image of the toner particles was used to measure the equivalent circle diameters of island-shaped resin particles having different contrast. The measurement was performed with the image analysis and particle size distribution measurement software MAC-VIEW (product of MOUNTECH Co., Ltd.). The samples used were 100 resin particles randomly selected. Each of the 100 resin particles was measured for the equivalent circle diameter, and the obtained values were averaged and used for evaluation.

<<Productivity>>

Whether toner particles could be granulated was evaluated according to the following evaluation criteria.

—Evaluation Criteria—

A: Toner particles could be granulated without any problems.

B: Toner particles could not be granulated; i.e., toner particles could not be obtained.

<<Charging Performance>>

Using IPSIO SP C310 (product of Ricoh Company Ltd.), sheets having an image occupation rate of 5% were continuously printed out in the N/N environment (temperature: 23° C., relative humidity: 45%). After the continuous printing processes of 50 sheets and 2,000 sheets (post-duration) in the N/N environment, the toner particles present on a developing roller during printing of blank images were aspirated by the aspiratory compact charge amount measuring device MODEL 210HS (product of TREK JAPAN, CO.), followed by measurement of the charge amounts. The difference between the charge amount measured after the 50-sheet printing process and the charge amount measured after the 2,000-sheet printing process was calculated to evaluate the charging performance of the toner particles based on the following evaluation criteria, where A or B is a level without any problems in practical use.

—Evaluation Criteria—

A: The difference between the charge amounts falls within the range of 15 μC/g (inclusive) to 25 μC/g (inclusive) as an absolute value.

B: The difference between the charge amounts falls within the range of 10 μC/g or greater but less than 15 μC/g as an absolute value.

C: The difference between the charge amounts is less than 10 μC/g as an absolute value.

<<Fogging>>

Using IPSIO SP C310 (product of Ricoh Company Ltd.), 1,000 sheets having an image occupation rate of 5% were continuously printed out in the N/N environment (temperature: 23° C., relative humidity: 45%) and the H/H environment (temperature: 27° C., relative humidity: 80%). Thereafter, the toner particles remaining on the photoconductor were removed with a piece of mending tape (product of Sumitomo 3M Limited) for evaluation of background smear, followed by measurement for L* with the spectrodensitometer XRITE 939. Here, the L* is a parameter corresponding to the brightness (chromatic luminosity). In the evaluation criteria, A or B is a level without any problems in practical use.

Evaluation Criteria—

A: $90 \leq L^*$

B: $85 \leq L^* < 90$

C: $L^* < 85$

<<Low-Temperature Fixing Property>>

Using IPSIO SP C310 (product of Ricoh Company Ltd.), solid images were formed on type 6200Y paper sheets (product of Ricoh Company Ltd.) at a toner deposition amount of 8.5±1 g/m$^2$, followed by fixing at 130° C.±2° C.

Using the drawing tester AD-401 (product of Ueshima Seisakusyo Co.), the fixed image portion was moved while the sapphire needle 125 μR was being in contact therewith under the conditions that the diameter of the diameter of the circle formed by the rotating needle: 8 mm and the load: 1 g. Then, the image portion moved over the tip of the sapphire needle was visually observed for scratches (tracks), to thereby evaluate the low-temperature fixing property. In the following criteria, A or B is a level without any problems in practical use.

—Evaluation Criteria—

A: Almost no tracks were observed.

B: When the image was observed directly therefrom, slight tracks were observed but the paper could not be seen.

C: When the image was observed directly therefrom, clear tracks were observed and the paper could be seen.

<<Releasing Property>>

There were prepared five sheets that were the same as used for the evaluation of the low-temperature fixing property. The prepared five sheets were caused to pass through the same fixing device at 200° C.±2° C., and evaluated for winding around the fixing roller according to the following criteria, where A or B is a level without any problems in practical use.

—Evaluation Criteria—

A: None of the five sheets were wound around the fixing roller.

B: One or two sheets out of the five sheets were wound around the fixing roller.

C: Three or more sheets out of the five sheets were wound around the fixing roller.

<<Filming Resistance>>

Each of the toners was set in the remodeled IPSIO SP C220 (product of Ricoh Company Ltd.) and was made to print out 5,000 sheets having an image occupation rate of 5%. Thereafter, a solid image was formed and visually observed for streaks for evaluation. In the following evaluation criteria, A or B is a level without any problems in practical use.

—Evaluation Criteria—

A: No streaks were observed in the image, nor were streaks observed in the thin layer of the developing roller.

B: No streaks were observed in the image, but streaks were observed in the thin layer of the developing roller.

C: Streaks were observed in the image.

<<Mechanical Strength>>

Each of the toners was set in IPSIO SP C310 (product of Ricoh Company Ltd.) and was made to print out 2,000 sheets having an image occupation rate of 5%. The toner was sampled and observed for the surface layer under an electron microscope for evaluation.

—Evaluation Criteria—

A: No charge-controlling resin particles were exfoliated from the toner particles.

B: Some charge-controlling resin particles were exfoliated from the toner particles.

C: Some charge-controlling resin particles were exfoliated from the toner particles, and the toner particles were broken.

TABLE 1

| | Toner particles | Base resin | Charge-controlling resin particles | Glass transition temp. Tg of charge-controlling resin particles (° C.) | Amount of charge-controlling resin particles per 100 parts by mass of base resin (parts by mass) | Charge-controlling agent | Amount of charge-controlling agent per 100 parts by mass of base resin (parts by mass) |
|---|---|---|---|---|---|---|---|
| Ex. 1 | Toner particles 1 | Resin 1 | Resin 3 | 84 | 6.0 | — | — |
| Ex. 2 | Toner particles 2 | Resin 1 | Resin 12 | 65 | 6.0 | — | — |
| Ex. 3 | Toner particles 3 | Resin 1 | Resin 4 | 84 | 6.0 | E-304 (Zn salicylate) | 0.6 |
| Ex. 4 | Toner particles 4 | Resin 1 | Resin 11 | 77 | 6.0 | E-304 (Zn salicylate) | 0.6 |
| Ex. 5 | Toner particles 5 | Resin 1 | Resin 6-1 | 80 | 6.0 | E-304 (Zn salicylate) | 0.6 |
| Ex. 6 | Toner particles 6 | Resin 1 | Resin 7 | 80 | 6.0 | TN-105 (Zr salicylate) | 0.6 |
| Ex. 7 | Toner particles 7 | Resin 1 | Resin 8 | 80 | 6.0 | LR-147 (organic boron complex) | 0.6 |
| Ex. 8 | Toner particles 8 | Resin 1 | Resin 6-1 | 80 | 3.0 | E-304 (Zn salicylate) | 0.3 |
| Ex. 9 | Toner particles 9 | Resin 1 | Resin 6-2 | 80 | 10.0 | E-304 (Zn salicylate) | 1.0 |
| Ex. 10 | Toner particles 10 | Resin 1 | Resin 6-3 | 85 | 7.0 | E-304 (Zn salicylate) | 0.7 |
| Ex. 11 | Toner particles 11 | Resin 1 | Resin 6-4 | 85 | 7.0 | E-304 (Zn salicylate) | 0.7 |
| Ex. 12 | Toner particles 12 | Resin 2 | Resin 6 | 80 | 9.0 | E-304 (Zn salicylate) | 0.9 |
| Ex. 13 | Toner particles 13 | Resin 1 | Resin 9 | 57 | 6.0 | — | — |
| Ex. 14 | Toner particles 14 | Resin 1 | Resin 4 | 84 | 6.0 | E-304 (Zn salicylate) | 0.6 |
| Comp. Ex. 1 | Toner particles 15 | Resin 1 | — | — | — | — | — |
| Comp. Ex. 2 | Toner particles 16 | Resin 1 | — | — | — | E-304 (Zn salicylate) | 2 |
| Comp. Ex. 3 | Toner particles 17 | Resin 1 | Resin 5 | 80 | 6.0 | — | — |
| Comp. Ex. 4 | Toner particles 18 | Resin 1 | Resin 4 | 84 | 1.8 | E-304 (Zn salicylate) | 0.2 |
| Comp. Ex. 5 | Toner particles 19 | Resin 1 | Resin 4 | 84 | 15.0 | E-304 (Zn salicylate) | 1.5 |
| Comp. Ex. 6 | Toner particles 20 | Resin 1 | Resin 10 | 70 | 5.0 | E-304 (Zn salicylate) | 0.5 |

TABLE 2

| | Volume average particle diameter of toner (μm) | Presence or absence of charge-controlling resin particles in base resin | Avg. amount of charge-controlling resin particles in a region 500 nm in depth from toner surface (% by volume) | Avg. embedment rate (%) | Charge amount of charge-controlling resin particles ($\mu C/m^2$) | Avg. equivalent circle diameter of charge-controlling resin particles (μm) |
|---|---|---|---|---|---|---|
| Ex. 1 | 5.5 | Presence | 45 | 96 | 105 | 200 |
| Ex. 2 | 5.3 | Presence | 50 | 95 | 125 | 180 |
| Ex. 3 | 5.5 | Presence | 45 | 96 | 205 | 200 |
| Ex. 4 | 6.1 | Presence | 44 | 96 | 175 | 170 |
| Ex. 5 | 5.5 | Presence | 50 | 100 | 175 | 190 |
| Ex. 6 | 5.4 | Presence | 50 | 100 | 150 | 200 |
| Ex. 7 | 5.2 | Presence | 50 | 100 | 125 | 180 |
| Ex. 8 | 5.1 | Presence | 22 | 100 | 175 | 200 |
| Ex. 9 | 6.2 | Presence | 69 | 100 | 175 | 330 |
| Ex. 10 | 6.2 | Presence | 54 | 99 | 175 | 90 |
| Ex. 11 | 6.5 | Presence | 60 | 100 | 175 | 410 |
| Ex. 12 | 6.8 | Presence | 65 | 100 | 175 | 360 |
| Ex. 13 | 5.3 | Presence | 38 | 100 | 125 | 250 |
| Ex. 14 | 6.5 | Presence | 50 | 100 | 205 | 150 |
| Comp. Ex. 1 | 5.0 | Absence | — | — | — | — |
| Comp. Ex. 2 | — | Absence | — | — | — | — |
| Comp. Ex. 3 | 5.5 | Presence | 50 | 100 | 50 | 190 |
| Comp. Ex. 4 | 5.0 | Presence | 17 | 100 | 205 | 200 |
| Comp. Ex. 5 | 5.2 | Presence | 73 | 100 | 205 | 200 |
| Comp. Ex. 6 | 5.1 | Presence | 32 | 85 | 250 | 280 |

TABLE 3

| | Productivity | Charging performance | Fogging | Low-temperature fixing property | Releasing property | Filming resistance | Mechanical strength |
|---|---|---|---|---|---|---|---|
| Ex. 1 | A | B | B | B | A | A | A |
| Ex. 2 | A | B | B | A | B | B | A |
| Ex. 3 | A | A | A | B | A | A | A |
| Ex. 4 | A | A | A | A | A | A | A |
| Ex. 5 | A | A | A | B | A | A | A |
| Ex. 6 | A | A | A | B | A | A | A |
| Ex. 7 | A | B | B | B | A | A | A |
| Ex. 8 | A | B | B | B | A | A | A |
| Ex. 9 | A | A | A | B | B | A | A |
| Ex. 10 | A | A | A | A | A | A | A |
| Ex. 11 | A | A | A | A | B | A | A |
| Ex. 12 | A | A | B | A | A | B | A |
| Ex. 13 | A | B | B | A | B | B | A |
| Ex. 14 | A | A | A | A | A | A | A |
| Comp. Ex. 1 | A | C | C | A | A | A | — |
| Comp. Ex. 2 | C | — | — | — | — | — | — |
| Comp. Ex. 3 | A | C | C | B | A | A | A |
| Comp. Ex. 4 | A | C | C | A | A | A | A |
| Comp. Ex. 5 | A | A | A | C | C | A | A |
| Comp. Ex. 6 | A | A | A | C | A | A | B |

Aspects of the present invention are as follows.

<1> A toner including:

a base resin; and charge-controlling resin particles contained in the base resin, wherein the toner is in shape of particles, and the charge-controlling resin particles are present in a region of each toner particle which is 500 nm in depth from a surface of the toner particle and an average of amounts of the charge-controlling resin particles present in the regions of the toner particles is 20% by volume to 70% by volume, wherein an average of embedment rates of the charge-controlling resin particles in the toner particles is 90% or higher, where each embedment rate is an average of embedment rates of the charge-controlling resin particles in each toner particle, and wherein the charge-controlling resin particles have a charge amount of 60 $\mu C/m^2$ or more as measured by a blow-off method.

<2> The toner according to <1>, wherein the charge amount of the charge-controlling resin particles as measured by the blow-off method is 100 $\mu C/m^2$ to 300 $\mu C/m^2$.

<3> The toner according to <1> or <2>, wherein the charge-controlling resin particles have an average equivalent circle diameter of 90 nm to 400 nm.

<4> The toner according to any one of <1> to <3>, wherein the charge-controlling resin particles have a glass transition temperature of 65° C. or higher.

<5> The toner according to any one of <1> to <4>, wherein the charge-controlling resin particles each contain a vinyl resin which contains as a constituent component an ester monomer in an amount of 20% by mass or more.

<6> The toner according to any one of <1> to <5>, wherein the charge-controlling resin particles each contain as a constituent component a styrene monomer in an amount of 20% by mass or more.

<7> The toner according to any one of <1> to <6>, wherein the charge-controlling resin particles each contain a charge-controlling agent which is at least one selected from the group consisting of a salicylic acid zinc complex, a salicylic acid zirconium complex and an organic boron complex.

<8> An image forming apparatus including:

a latent electrostatic image bearing member;

a latent electrostatic image forming unit configured to form a latent electrostatic image on the latent electrostatic image bearing member;

a developing unit configured to develop the latent electrostatic image with a developer to form a visible image;

a transfer unit configured to transfer the visible image onto a recording medium; and a fixing unit configured to fix the transferred visible image on the recording medium, wherein the developer includes the toner according to any one of <1> to <7>.

<9> A method for producing a toner, the method including:

dissolving or dispersing at least a resin and a colorant in an organic solvent to prepare an oil phase;

preparing an aqueous phase containing an aqueous medium;

dispersing the oil phase in the aqueous phase to prepare a dispersion liquid where toner base particles formed of the oil phase are dispersed; and adding charge-controlling resin particles to the dispersion liquid where the toner base particles formed of the oil phase are dispersed.

<10> A method for producing a toner, the method including:

dissolving or dispersing at least a resin and a colorant in an organic solvent to prepare an oil phase;

preparing an aqueous phase containing an aqueous medium;

adding charge-controlling resin particles to the aqueous phase; and dispersing the oil phase in the aqueous phase to which the charge-controlling resin particles have been added, to thereby prepare a dispersion liquid where toner base particles formed of the oil phase are dispersed.

This application claims priority to Japanese application No. 2011-137493, filed on Jun. 21, 2011, and incorporated herein by reference.

What is claimed is:

1. A toner comprising:

a base resin; and charge-controlling resin particles contained in the base resin, wherein the toner is in shape of particles, and the charge-controlling resin particles are present in a region of each toner particle which is 500 nm in depth from a surface of the toner particle and an average of amounts of the charge-controlling resin particles present in the regions of the toner particles, which is obtained from cross-sectional images of the toner particles under a transmission electron microscope, is 20% by area to 70% by area, wherein an average of embedment rates of the charge-controlling resin particles in the toner particles is 90% or higher, where each embedment rate is an average of embedment rates of the charge-controlling resin particles in each toner particle, and wherein the charge-controlling resin particles have a charge amount of 60μC/$m^2$ or more as measured by a blow-off method, and wherein the charge-controlling resin particles each contain a charge-controlling agent which is at least one selected from the group consisting of a salicylic acid zinc complex, a salicylic acid zirconium complex and an organic boron complex.

2. The toner according to claim 1, wherein the charge amount of the charge-controlling resin particles as measured by the blow-off method is 100 μC/$m^2$ to 300 μC/$m^2$.

3. The toner according to claim 1, wherein the charge-controlling resin particles have an average equivalent circle diameter of 90 nm to 400 nm.

4. The toner according to claim 1, wherein the charge-controlling resin particles have a glass transition temperature of 65° C. or higher.

5. The toner according to claim 1, wherein the charge-controlling resin particles each contain a vinyl resin which contains as a constituent component an ester monomer in an amount of 20% by mass or more.

6. The toner according to claim 1, wherein the charge-controlling resin particles each contain as a constituent component a styrene monomer in an amount of 20% by mass or more.

* * * * *